US007074495B2

(12) United States Patent
Tamagawa et al.

(10) Patent No.: US 7,074,495 B2
(45) Date of Patent: Jul. 11, 2006

(54) RECORDING MATERIAL SUPPORT, PROCESS FOR MANUFACTURING THE SAME, RECORDING MATERIAL AND PROCESS FOR IMAGE FORMATION

(75) Inventors: Shigehisa Tamagawa, Shizuoka (JP); Yasuhiro Ogata, Shizuoka (JP); Yoshio Tani, Shizuoka (JP); Yoshisada Nakamura, Shizuoka (JP); Ashita Murai, Shizuoka (JP); Hiroshi Yamamoto, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 299 days.

(21) Appl. No.: 10/410,132

(22) Filed: Apr. 10, 2003

(65) Prior Publication Data

US 2003/0198885 A1 Oct. 23, 2003

(30) Foreign Application Priority Data

Apr. 11, 2002 (JP) ..... 2002-109634
Apr. 24, 2002 (JP) ..... 2002-121739
Feb. 21, 2003 (JP) ..... 2003-044761

(51) Int. Cl.
*B41M 5/00* (2006.01)

(52) U.S. Cl. ..... 428/537.5; 427/146; 428/32.21; 428/32.39; 428/195.1; 428/211.1; 430/124; 503/200; 503/227

(58) Field of Classification Search ..... 428/195.1, 428/211.1, 537.5, 32.21, 32.39; 427/146; 430/124; 503/200, 227
See application file for complete search history.

(56) References Cited

U.S. PATENT DOCUMENTS 4,800,192 A * 1/1989 Tamagawa et al. ..... 503/200

FOREIGN PATENT DOCUMENTS

| | | |
|---|---|---|
| JP | 5-241366 | 9/1993 |
| JP | 8-22137 | 1/1996 |
| JP | 8-72394 | 3/1996 |

* cited by examiner

*Primary Examiner*—Bruce H. Hess
(74) *Attorney, Agent, or Firm*—Sughrue Mion, PLLC

(57) ABSTRACT

The present invention aims to provide a recording material support having superior excellent surface smoothness and water resistance compared to the related art, to a process for efficiently manufacturing this recording material support, to a recording material which can form an image having excellent quality and gloss using this recording material support, and to process for image formation using this recording material. For this purpose, the recording material support comprising at least raw paper satisfies at least one condition selected from the Cobb size (30 seconds) of the surface on the side provided with the image-forming layer of the support, Oken type smoothness, Stökigt sizing degree, central square average roughness (SRa) and variation amount (ΔSRa) of SRa.

21 Claims, 1 Drawing Sheet

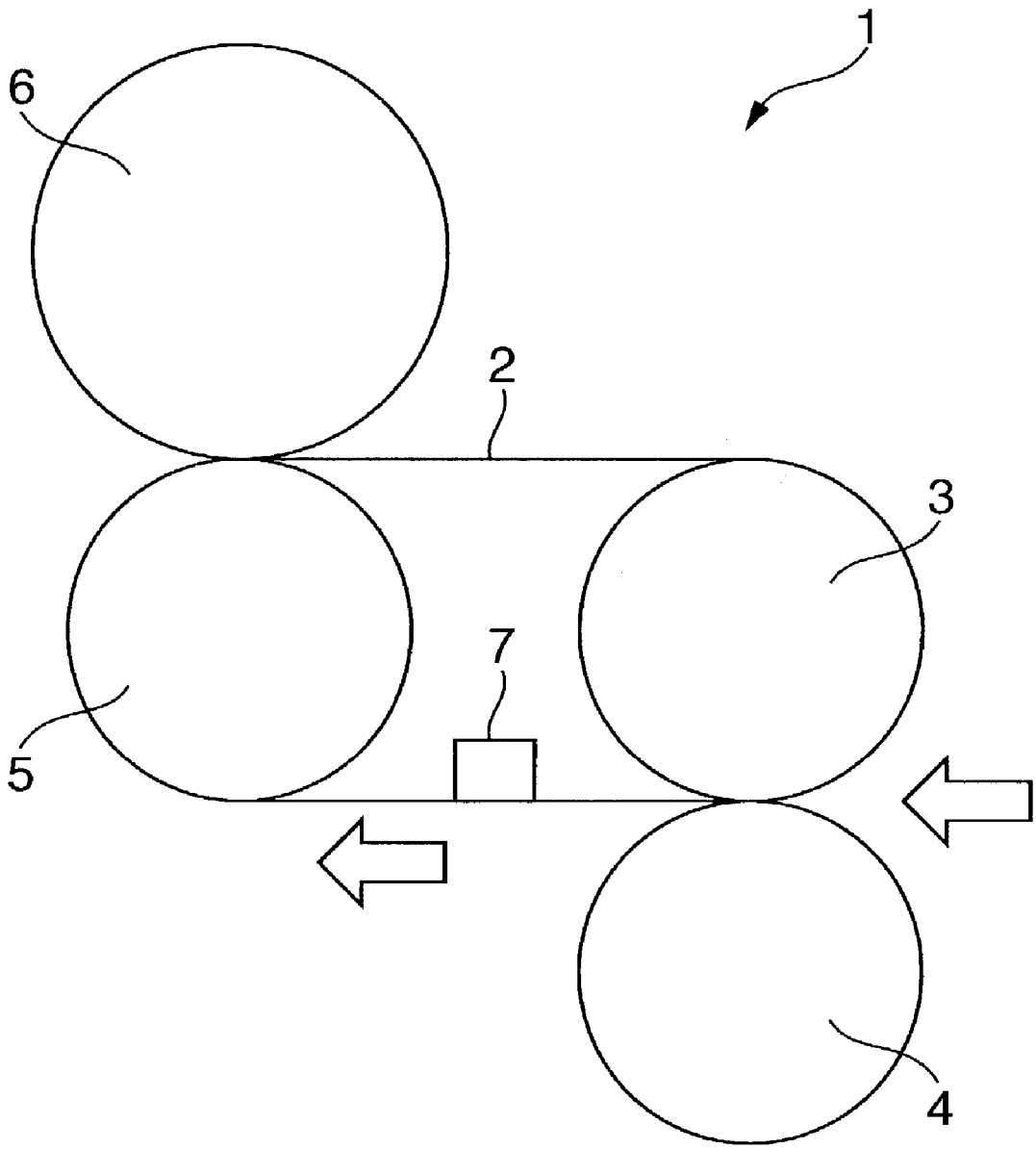
1
6
2
3
7
5
4

RECORDING MATERIAL SUPPORT, PROCESS FOR MANUFACTURING THE SAME, RECORDING MATERIAL AND PROCESS FOR IMAGE FORMATION

BACKGROUND OF THE INVENTION

1. Field of the Invention

The present invention relates to a recording material support which has superior surface smoothness and water resistance, to an efficient process for manufacturing the same, to a recording material using the same which is capable of forming an image with excellent image quality and gloss, and to process for image formation using the recording material.

2. Description of the Related Art

In the related art, in order to obtain high quality images, high surface smoothness and water resistance are required to supports for various recording materials such as an electrophotographic image-forming material, a thermosensitive color recording material, an ink-jet recording material, a sublimation transfer image-receiving material, a silver photographic photosensitive material and a heat transfer image-receiving material, and various studies have been performed therefor.

On the other hand, in commercial printing and high-class printing, offset printing is widely used, and coated paper, such as art paper and coat paper, is employed. This is because the surface of coated paper is very smooth, so ink transfer properties are good, image reproducibility is high, image gloss is high and color reproducibility is good.

However, the coating layer of coated paper contains a large amount of pigment, and has high hygroscopic properties. Therefore, if coated paper itself is used as an image-receiving sheet for electrophotography and the image is fixed with heat, steam within the coated paper expands by the heat, so blistering (swelling of the coating layer) occurs between the raw paper and the coating layer. If this happens, the image is ruined, and a fine image like a photograph cannot be obtained (e.g., Japanese Patent Application id-Open (JP-A) Nos. 04-212168 and 08-211645).

In the conventional coated paper, when image information such as faces, scenery, or the like is output as a photograph, there is also a problem of inferior gloss. Therefore, at present, coated paper is hardly ever used as an electrophotographic image-receiving sheet.

JP-A No. 05-173352 discloses electrophotographic image-receiving paper, which uses a specific sizing agent and sets a sizing degree (Stökigt sizing degree) of raw paper within a predetermined range. However, in this publication, the Stökigt sizing degree of the raw paper surface is as low as 10 seconds to 20 seconds, and no reference is made to a very large Stökigt sizing degree of 100 seconds or more.

JP-A No. 05-241366 discloses coated paper, which can be used as electrophotographic image-receiving paper, and uses raw paper having an Oken type smoothness of 35 seconds to 200 seconds. However, on the raw paper used here, a recording layer (toner image-receiving layer) contains a large amount of pigment. Therefore, problems such as streaks are often encountered when using the pigment-based coating layer, in particular when the Oken type smoothness is more than 200 seconds.

In JP-A No. 2000-235276, a thick electrophotographic recording sheet is disclosed having an Oken type smoothness of 70 seconds to 200 seconds. However, this publication also states that if the Oken type smoothness is 200 seconds or more, problems arises in paper feed such that none or several sheets are often fed at once.

SUMMARY OF THE INVENTION

It is therefore an object of the present invention to provide a recording material support which has superior surface smoothness and water resistance, to provide a process for manufacturing a recording material support which enables an efficient manufacture of the recording material support, and to provide a recording material using the recording material support which forms an image having superior image quality and gloss.

It is also a object of the present invention to provide a process for image formation which, even when an oil-less machine without fixing oil is used, can achieve a stable paper feed without offset to the fixing roller and the fixing belt, and can form a satisfactory image having unprecedentedly good glossiness.

The recording material support of the present invention comprises at least raw paper, and satisfies any one of the following conditions: (i) Cobb size (30 seconds) of a surface of the recording material support, where an image-forming layer is provided, is 10 g/m$^2$ or less; (ii) Oken type smoothness of a surface of the recording material support, where an image-forming layer is provided, is 210 seconds or more, and Stökigt sizing degree thereof is 100 seconds or more; (iii) Central square average roughness (SRa) measured at a cutoff of 5 mm to 6 mm on a surface of the recording material support, where an image-forming layer is provided, is 0.7 μm or less, and variation [ΔSRa;(SRa before contacting water)−(SRa after contacting water)] of the SRa before and after the surface thereof is brought into contact with water at 20° C. for 2 minutes, is in the range of −0.1 μm to +0.1 μm. Consequently, a recording material support having excellent surface smoothness and water resistance, which is especially suitable for recording materials such as an electrophotographic image-receiving material, ink-jet recording material, silver halide photosensitive material, sublimation transfer image-receiving material, thermosensitive color recording material and hot transfer image-receiving material, is obtained.

The process for manufacturing the recording material support of the present invention comprises the steps of: applying a coating solution on a surface of raw paper of the recording material support, where a image-forming layer is provided; and performing a calender treatment on the raw paper after the step of applying, in which the recording material comprises the raw paper, and the coating solution comprises a surface-treating agent at least one selected from a soap-free latex and a soap free emulsion. Thereby, a recording material support having excellent surface smoothness and water resistance can be efficiently manufactured.

The recording material support of the present invention is used as a support for the recording material of the present invention. As a result, an image of excellent quality and gloss is formed whether the material is used as an electrophotographic image-receiving material, an ink-jet recording material, a silver photographic photosensitive material, a sublimation transfer image-receiving material, a thermosensitive color recording material or a heat transfer image-receiving material.

The process for image formation of the present invention uses an electrophotographic image-receiving material, which comprises a support, and a toner image-receiving layer provided on at least one surface of the support, and the support is the recording material support of the present invention. A toner image is first formed on the electrophotographic image-receiving material, and after heating and pressurizing a surface of the electrophotographic image-receiving material, where the toner image is formed on, using a fixing belt and a fixing roller and then subject the electrophotographic image-receiving material, in which the toner image is fixed thereon, to cool. After cooling, the electrophotographic image receiving material is separated from the fixing belt. Thus, even if an oil-less machine without fixing oil is used, a stable feed without offset to the fixing roller and the fixing belt can be achieved, and a good image having unprecedented glossiness, which has desirable photographic texture can be obtained.

BRIEF DESCRIPTION OF THE DRAWING

FIGURE is a diagram showing an example of an electrophotographic apparatus having a fixing belt system according to the present invention.

DESCRIPTION OF THE PREFERRED EMBODIMENTS (Recording Material Support)

The recording material support of the present invention comprises raw paper, and on a surface of the recording material support where an image-forming receiving layer is provided, it satisfies at least one of conditions selected from among the Cobb size (30 seconds), Oken type smoothness, Stökigt sizing degree, the central square average roughness (SRa), and the variation (ΔSRa) of SRa, which are precisely described hereinafter.

Raw Paper

There is no particular limitation on the raw paper, and it can be suitably selected according to the intended purpose. Specifically, high quality paper is preferable such as the paper described in "Fundamentals of Photography—Silver Photography" edited by the Society of Photographic Science and Technology of Japan, published by Corona Publishing Co. Ltd., (1975), pp. 223 to 240.

In the aforesaid raw paper, it is preferred to use pulp fibers having a fiber length distribution as disclosed for example by Japanese Patent Application Laid-Open (JP-A) No. 58-68037 (e.g., the sum of 24-mesh screen residue and 42-mesh screen residue is 20% by mass to 45% by mass, and 24-mesh screen residue is 5% by mass or less) in order to give a desired central line average roughness to the surface. Moreover, the central line average roughness can be adjusted by giving a surface treatment of heat and pressure in a machine calender, a super calender, and the like.

The raw paper has no particular limitation and can be selected from any known material for image recording material support in the art. Examples may include natural pulps of such as needle-leaf tree and broad-leaf tree, synthetic pulps made of synthetic resins such as polyethylene and polypropylene, mixtures of natural pulps and synthetic pulps, and the like.

Regarding pulps used as materials for the raw paper, from the viewpoint of obtaining efficient and well balanced qualities of surface flatness, rigidity and dimensional stability (curling property) of the raw paper, broad-leaf tree bleached kraft pulp (LBKP) is preferably used, but needle-leaf bleached kraft pulp (NBKP), broad-leaf tree sulfite pulp (LBSP), or the like can also be used.

A beater, a refiner, and the like can be used for beating the pulp.

In terms of controlling paper shrinkage in a step of paper-making, the Canadian Standard Freeness of the pulp is preferably 200 ml C.S.F to 440 ml C.S.F, and more preferably 250 ml C.S.F to 380 ml C.S.F.

Various additives are added to the pulp slurry (may also be referred as "pulp" hereinafter) which is obtained after beating the pulp, according to the intended purpose.

Example of the additives may include fillers, dry paper reinforcers, sizing agents, wet paper reinforcers, fixing agents, pH regulators, other agents, and the like.

Examples of the fillers are calcium carbonate, clay, kaolin, white clay, talc, titanium oxide, diatomaceous earth, barium sulfate, aluminum hydroxide, magnesium hydroxide and the like.

Examples of the dry paper reinforcers are cationic starch, cationic polyacrylamide, anionic polyacrylamide, amphoteric polyacrylamide, carboxy-modified polyvinyl alcohol and the like.

Examples of the wet paper reinforcers are a polyamine-polyamide-epichlorohydrin resin, a melamine resin, a urea resin, an epoxy polyamide resin and the like.

Examples of the fixing agents are polyfunctional metal salts such as aluminum sulfate and aluminum chloride, and cationic polymers such as cationic starch and the like.

Examples of the pH regulators are caustic soda, sodium carbonate and the like.

Examples of other agents are defoaming agents, dyes, slime control agents, florescent whitening agents and the like.

A softening agent can also be added, if necessary. Examples of the softening agent are given in the "New Paper Treatment Handbook", (edited by Paper Chemical Time Co., pp. 554 to 555 (published in 1980).

Treatment liquids used for surface sizing may include water-soluble polymers, waterproof materials, pigments, dyes, florescent whitening agents and the like.

Examples of the water-soluble polymers are cationic starch, polyvinyl alcohol, carboxy-modified polyvinyl alcohol, carboxymethylcellulose, hydroxyethylcellulose, cellulose sulfate, gelatin, casein, sodium polyacrylate, styrene-maleic anhydride copolymer sodium salt, sodium polystyrene sulfonate and the like.

Examples of the waterproof substances are latex emulsions of styrene-butadiene copolymer, ethylene-vinyl acetate copolymer, polyethylene vinylidene chloride copolymer or the like, a polyamide-polyamine-epichlorohydrin resin, and the like.

Examples of the pigments are calcium carbonate, clay, kaolin, talc, barium sulfate, titanium oxide and the like.

From the viewpoint of improving rigidity and dimensional stability (curling property) of the raw paper, it is preferred that the ratio (Ea/Eb) of the longitudinal Young's modulus (Ea) and the transverse Young's modulus (Eb) is in the range of 1.5 to 2.0. If the value of Ea/Eb is less than 1.5, or, more than 2.0, rigidity or curling properties of the recording material may be impaired, and running state during transfer of the recording material may be also impaired as a result. Accordingly, it is preferred that the ratio (Ea/Eb) is within the aforesaid range.

It has been found that in general, "stiffness" of paper differs based on differences in the way the paper is beaten. The elasticity (modulus) of paper formed by paper-making, after beating, can be used as an important indication of the "stiffness" of paper. The elastic modulus of paper may be calculated from the following equation by using the relation of dynamic modulus of elasticity, which shows the physical properties of a visco-elastic body of the paper, and density, and measuring the velocity of sound propagation in the paper using an ultrasonic oscillator.

$$E=\rho c^2(1-n^2)$$

[in the above equation "E" is dynamic modulus of elasticity, "ρ" is density, and "c" is acoustic velocity in paper. "n" is Poisson's ratio.]

As "n" is approximately 0.2 (n=0.2) in the case of ordinary paper, the elastic modulus of paper can also be calculated by the following equation without considerable errors:

$$E=\rho c^2$$

That is, if the density of paper and acoustic velocity can be measured, the elastic modulus can easily be calculated. In the above equation, when measuring acoustic velocity, various instruments known in the art may be used, such as a Sonic Tester SST-110 (Nomura Shoji Co., Ltd.).

There is no particular limitation on thickness of the aforesaid raw paper and it can be suitably selected according to the intended purpose. The thickness of the raw paper is preferably 30 μm to 500 μm, more preferably 50 μm to 300 μm, and still more preferably 100 μm to 250 μm. There is no particular limitation on basis weight of the aforesaid raw paper and it can be suitably selected according to the intended purpose. The basis weight of the raw paper is, for example, preferably 50 g/m$^2$ to 250 g/m$^2$, and more preferably 100 g/m$^2$ to 200 g/m$^2$.

In the present invention, the Cobb size (30 seconds) of a surface of the recording material support, where an image-forming layer is provided, is less than 10 g/m$^2$, and preferably less than 5 g/m$^2$. The lower limit of the Cobb size (30 seconds) is about 0.5 g/m$^2$.

The Cobb size (30 seconds) is measured by Cobb test specified by JIS P 8140. Specifically, the Cobb size measures the water absorption when the support is brought in contact with pure water for 30 seconds.

In order to achieve a Cobb size (30 seconds) of 10 g/m$^2$ or less, although specific examples are given in [Examples], it can be adjusted by one of the following methods, or a combination thereof.

(1) A surface of the raw paper, where an image-forming layer is provided, is impregnated or coated with a water repellent, a sizing agent and a water-resisting agent.

Examples of the water repellent are silicone compounds, modified silicones, cured silicones, Carbowax and the like.

Examples of the sizing agent are fatty acid salts, rosin, rosin derivatives such as rosin maleate, paraffin wax, alkyl ketene dimers, alkenyl succinic anhydride (ASA), compounds containing higher fatty acids such as epoxy fatty acid amides, and the like. Of these, alkyl ketene dimers and epoxy fatty acid amides are particularly preferred.

There is no particular limitation on an addition amount of the sizing agent and it may be suitably selected according to the intended purpose. The addition amount thereof is preferably 0.3% by mass or more, and more preferably 0.5% by mass, relative to the pulp mass of the raw paper.

Examples of the water-resisting agent are latex emulsions of styrene-butadiene copolymer, ethylene-vinylacetate copolymer, polyethylene, vinylidene chloride copolymer or the like, a polyamide-polyamine-epichlorhydrin resin, and the like.

There is no particular limitation on a method of coating or impregnating the surface of the raw paper with the water repellent, the sizing agent or the water-resisting agent, and it can be suitably selected according to the intended purpose. Examples thereof may include a horizontal size press, size bus, gate roll coater, film transfer coater, rod coater, bill blade coater, spray coater, air knife coater, curtain coater and the like. Of these, the gate roll coater and the curtain coater are preferred.

(2) A surface-treating agent is applied or impregnated on a surface of the raw paper where an image-forming layer is provided.

There is no particular limitation on the surface-treating agent, and it can be suitably selected according to the intended purpose. Preferable surface-treating agents are for example emulsions and latexes, particularly preferable surface-treating agents are for example soap-free emulsions and soap-free latexes.

Examples of the emulsions are hydrocarbon waxes such as paraffin wax, microcrystalline wax, and the like; oxygen-containing waxes such as carnauba wax, montan wax, paraffin oxide and the like; hydrocarbon resins such as a petroleum resin, a cumarone indene resin, a terpene resin, carboxylic acid adducts thereof, and the like; polyolefines such as polyethylene, polypropylene, and the like; emulsions of acryl, acrylstyrene, polyester, and the like; and other emulsions such as alkyl ketene dimers and epoxy fatty acid amides. Of these, soap-free emulsions are preferred.

The soap-free emulsions are preferably an acrylic soap-free emulsion or polyolefine soap-free emulsions. The acrylic soap-free emulsions include acrylic ester homopolymers and copolymers of acrylic esters with methacrylic esters, vinylacetate, styrene, acrylonitrile, acrylic acid, and the like. The polyolefine soap-free emulsions include ethylene vinylacetate copolymer emulsions, ethylene acrylic acid copolymers, ionomers, and the like.

Various additives may be blended with the soap-free emulsions, if necessary, such as a matting agent, a pigment, a plasticizer, a releasing agent, a lubricant, a thickener, an antistatic agent, a florescent whitening agent, a tint adjusting dye, and the like.

Examples of the latex are various latex such as SBR, MBR, PVdc and the like. Of these, soap-free latex is preferred. A preferable aspect of the soap-free latex may be core/shell latex particles obtained by an emulsion polymerization method which does not use an emulsifier (surfactant) (e.g., "Synthesis, Design and New Applications of Acrylic Resins" (published by Central Management Development Center, Jul. 1, 1985), pp. 279 to 281.

Examples of such manufacturing method of the soap-free latex are a seeding method, a reactant emulsifier method, an oligomer method, and the like.

The seeding method is a method in which a water-dispersible polymer is prepared beforehand, and a monomer is added as a seed polymer thereto so as to polymerize.

In this seeding method, the seed polymer forms a core, and as the polymerization of the monomer proceeds, the polymer forms a shell, resulting in a core/shell structure.

In the reactant emulsifier method, a compound (reactant emulsifier), which has an ethylenic unsaturated bond and an anionic or non-ionic hydrophilic group in a molecule thereof, is used like a conventional emulsifier. However, the reactant emulsifier used is incorporated into the polymer produced, and does not remain as an emulsifier.

Various types of reactant emulsifier are known in the art, for example, acrylic acid derivatives (JP-A Nos. 55-11252, and 56-28208), itaconic acid derivatives (JP-A No. 51-30284), maleic acid derivatives (JP-A No. 51-30284, JP-B No. 56-29657), fumaric acid derivatives (JP-A Nos. 51-30285, and 51-30284) and the like.

Seed polymers which are specifically suitable for manufacturing the aforesaid core/shell latex resin composition may be prepared by an emulsion polymerization method, a suspension polymerization method or a dispersion polymerization method. Of these, it is appropriate to use a seed polymer prepared by the emulsion polymerization method. Although an emulsifier is used in the emulsion polymerization method, the amount of emulsifier can be largely reduced in the separation and purification steps. Also, even if the seed polymer contains a small amount of emulsifier, the seed polymer is incorporated in the core/shell structure and is not present on the surface, so it is not easily influenced by moisture. On the other hand, when the seed polymer is prepared by the suspension polymerization method and the dispersion polymerization method, a complex process is required to remove the dispersant and the solvent.

The seed polymer may suitably be a water-soluble polymer, such as polyacrylates and their copolymers, gelatin, tragacanth gum, starch, methyl cellulose, hydroxyethyl cellulose, carboxymethylcellulose, polyvinyl alcohol, polyvinyl pyrrolidone, or the like.

In the seeding method, the monomer added may be any ethylenic unsaturated monomer as long as it undergoes radical polymerization in the presence of the seed polymer. In this case, it may be identical to or different from the monomer used for manufacturing the seed polymer.

Examples of the monomer are (meth)acrylic-ester monomers, monochrome vinylaromatic monomers, (meth)vinylester monomers, vinylether monomers, mono-olefin monomers, diolefin monomers, halogenated olefin monomers, polyvinyl monomers, and the like.

Examples of the (meth)acrylic monomers are (meth) acrylic acid, methyl(meth)acrylate, ethyl(meth)acrylate, butyl (meth)acrylate, 2-ethylhexyl(meth)acrylate, cyclohexyl (meth)acrylate, phenyl(meth)acrylate, methyl(meth) acrylate, ethyl β-hydroxyacrylate, propyl γ-aminoacrylate, stearyl methacrylate, dimethyl aminoethyl methacrylate and diethyl aminoethyl methacrylate, mixtures thereof, and the like.

Examples of the aromatic vinyl monomers are styrene monomers such as styrene, o-methylstyrene, m-methylstyrene, p-methylstyrene, p-methoxystyrene, p-phenylstyrene, p-chlorostyrene, p-ethylstyrene, p-butylstyrene, p-t-butylstyrene, p-hexylstyrene, p-octylstyrene, p-nonylstyrene, p-decylstyrene, p-dodecylstyrene, 2,4-dimethylstyrene, 3,4-dichlorostyrene, or the like; derivative thereof, mixtures thereof, and the like.

Examples of the vinylester monomers are vinylacetate, vinylpropionate, vinylbenzoate, and the like.

Examples of the vinylether monomers are vinylmethyl ether, vinylethyl ether, vinylisobutyl ether, vinylphenyl ether, and the like.

Examples of the olefinic monomers are mono-olefin monomers such as ethylene, propylene, isobutylene, 1-butene, 1-pentene or 4-methyl-1-pentene, and the like; and diolefin monomers such as butadiene, isoprene, chloroprene, and the like; and the like.

To improve the properties of the seed polymer, a crosslinking monomer may be added. Examples of such crosslinking monomers are those containing two or more unsaturated bonds, such as divinylbenzene, divinylnaphthalene, divinylether, diethylene glycol methacrylate, ethylene glycol dimethacrylate, polyethylene glycol dimethacrylate, diallyl phthalate, and the like.

In this seeding method, a radical polymerization initiator can be used. Any radical polymerization initiator can be used if it is water-soluble. Examples of such polymerization initiators are persulfates (potassium persulfate, ammonium persulfate, and the like), azo-compounds(4,4'-azobis-4-cyanovaleric acid and its salts, 2,2'-azobis(2-amidinopropane) salts, and the like), peroxide compounds, and the like.

The polymerization initiator may also be used as a redox initiator in combination with a reducing agent. By using this redox initiator, polymerization activity is increased, polymerization temperature can be reduced, and a shortening of polymerization time can be expected.

As long as the polymerization temperature is higher than the minimum radical formation temperature of the polymerization initiator, any temperature may be selected, but the range of 50° C. to 80° C. is usually used. However, it is also possible to polymerize at room temperature or a lower temperature by using a polymerization initiator, which initiates at room temperature, such as a hydrogen peroxide-reducing agent (e.g., ascorbic acid) combination.

In the core/shell latex particles, the number average molecular weight (Mn (c)) of the core, is preferably 30,000 to 500,000 and more preferably 40,000 to 400,000. On the other hand, the number average molecular weight [Mn (s)] of the shell is preferably 4,000 to 30,000, and more preferably 5,000 to 20,000.

In the aforesaid core/shell latex particles, the mass ratio of the core and the shell (core/shell) is preferably 10/90 to 90/10, and more preferably 20/80 to 80/20. If the mass ratio of the core and the shell (core/shell) departs from this range, the core/shell structure does not fully manifest its properties, which will approach the properties of a simple continuous film.

The average particle size of the core/shell latex particles is preferably 0.2 μm or less, and more preferably 0.1 μm or less. The minimum average particle size is about 0.04 μm. If the average particle diameter more than 0.2 μm, the features of the core/shell structure cannot be efficiently employed.

Various additives, such as a matting agent, a pigment, a plasticizer, a releasing agent, a lubricant, a thickener, an antistatic agent, a florescent whitening agent and a tint adjusting dye, can be further blended with the soap-free latex coating solution if necessary.

The glass transition temperature (Tg) of the resin in the soap-free latex or the soap-free emulsion is preferably 30° C. or more, and more preferably 50° C. or more. The coating or impregnation amount of the soap-free latex or the soap-free emulsion is preferably 0.5 $g/m^2$to 10 $g/m^2$, and more preferably 1 $g/m^2$ to 5 $g/m^2$, in terms of solids.

In the present invention, the Oken type smoothness of a surface of the recording material support, where an image-forming layer is provided, is 210 seconds or more, and preferably 250 seconds or more. If the Oken type smoothness is less than 210 seconds, image quality becomes poor and it is therefore undesirable. There is no particular limitation to the maximum of the Oken type smoothness, but in practice, it is preferably about 600 seconds, and more preferably about 500 seconds.

Here, the "Oken type smoothness" is the smoothness specified by the method of JAPAN TAPPI No. 5 B.

In order to attain the aforesaid Oken type smoothness, although specific methods are shown in [Examples], they can be adjusted by one of the following methods or a combination thereof.

(1) Adjustment of Beating Conditions

Beating conditions can be adjusted so as to adjust the pulp mass average fiber length after beating, for example, preferably to the range of 0.40 mm to 0.70 mm, and more preferably to the range of 0.50 mm to 0.65 mm.

(2) Surface Calender Treatment

The surface of the raw paper is calender-treated to increase the raw paper density. For example, the raw paper density is preferably 0.80 g/cm$^3$ to 1.15 g/cm$^3$, and more preferably 0.90 g/cm$^3$ to 1.10 g/cm$^3$.

In order to efficiently increase the surface smoothness, the temperature of calender treatment (roller temperature of calender) is preferably adjusted to 90° C. to 180° C., and more preferably to 110° C. to 160° C.

In the present invention, together with the Oken type smoothness, the Stökigt sizing degree is 100 seconds or more, and preferably 150 seconds or more.

The Stökigt sizing degree is the sizing degree specified by JIS P8122. The Stökigt sizing degree is determined by floating a sample on a 2% by mass rhodan ammonium solution, dropping one drop of 1% by mass ferric chloride solution on the sample and measuring the time, in seconds, until red spots develops in the sample. Hence, the longer this time is, the larger the sizing property suppressing penetration of the solution.

The Stökigt sizing degree, as it is specifically described in [Examples], can be adjusted by one of the following methods, or a combination thereof.

(1)Adjustment of Sizing Agent

For example, the sizing agent is preferably 0.3% by mass or more, and more preferably 0.3% by mass to 1.5% by mass, relative to the pulp mass. In this way, the wettability of the raw paper can be greatly reduced.

The sizing agent is preferably an alkyl ketene dimer, alkenyl succinic anhydride (ASA) or a compound containing a higher fatty acid, such as epoxy fatty acid amide.

(2) Adjustment of Voids in the Raw Paper

By giving calender treatment, as in the case of the Oken type smoothness, the raw paper density is adjusted to preferably 0.8 g/cm$^3$ or more, and more preferably 0.85 g/cm$^3$ or more. The upper limit is preferably about 1.15 g/cm$^3$.

In the present invention, the central square average roughness (SRa) measured at a cutoff of 5 mm to 6 mm on a surface of the recording material support, where an image-forming layer is provided, is 0.7 μm or less, and preferably 0.5 μm or less. The lower limit is about 0.2 μm. When the central square average roughness (SRa) at a curve length of 5 mm to 6 mm falls, the support surface appears flat to the naked eye.

Herein the central square average roughness (SRa) is the average roughness obtained by scanning the roughness of a fixed plane in three dimensions, and is different from the central line average roughness (Ra) obtained by scanning the linear roughness of a plane. The central square average roughness (SRa) is for example obtained by measuring the central square average roughness (SRa) at a cutoff of 5 mm to 6 mm based on the following measurement and analysis conditions using a surface shape measuring apparatus, Surfcom 570A-3DF (Tokyo Seimitsu Co., Ltd.).

| Measurement and analysis conditions | |
|---|---|
| Scanning direction: | MD direction of sample |
| Measurement length: | 50 mm in the papermaking (X) direction, 30 mm in the perpendicular direction (Y) |
| Measurement pitch: | 0.1 mm in the X direction, 0.1 mm in the Y direction |
| Scanning speed: | 30 mm/sec |
| Band pass filter: | 5 mm to 6 mm |

Together with the conditions of central square average roughness (SRa), it is preferred to satisfy the condition that the variation [ΔSRa;(SRa before contacting water)−(SRa after contacting water)] being within the range of −0.1 μm to +0.1 μm, and preferably within the range of −0.05 μm to +0.05 μm. The variation [ΔSRa;(SRa before contacting water)−(SRa after contacting water)] is calculated the differences in the SRa between before and after a surface of the recording material, where an image-forming layer is applied, is brought into contact with water at 20° C. for 2 minutes.

Herein, the method of bringing the surface of the recording material support where an image-forming layer is provided, into contact with water is based on Cobb test specified by JIS P 8140.

If the central square average roughness (SRa) is more than 0.7μm and this variation (ΔSRa) of SRa departs from the range of −0.1 μm to +0.1 μm, the smoothness of the support is spoiled, and a high quality image cannot be obtained.

In the present invention, the Bekk smoothness of a surface of the recording material support, where an image-forming layer is provided, is preferably 100 seconds or more, and more preferably 150 seconds or more.

If it is less than 100 seconds, the toner image quality becomes poor and is thus undesirable. There is no particular limitation on the maximum value of the Bekk smoothness, but in practice, it is about 600 seconds and preferably about 500 seconds. Here, the Bekk smoothness is the smoothness specified by JIS P 8119.

In order to attain the aforesaid surface smoothness [central square average roughness (SRa), variation (ΔSRa) of SRa and Bekk smoothness range] of the recording material support, although specific methods are shown in [Examples], they can be adjusted by one of the following methods, or a combination thereof.

(1) Adjustment of Beating Conditions

Beating conditions can be adjusted so as to adjust the pulp mass average fiber length after beating, for example, preferably to the range of 0.40 mm to 0.60 mm, and more preferably to the range of 0.50 mm to 0.65 mm.

(2) Surface Calender Treatment

The raw paper surface is calender-treated to increase the raw paper density. For example, the raw paper density is preferably 0.80 g/cm$^3$ to 1.15 g/cm$^3$, and more preferably 0.90 g/cm$^3$ to 1.10 g/cm$^3$.

In order to efficiently increase the surface smoothness, the temperature of calender treatment (roller temperature of calender) is preferably adjusted to 110° C. or more, more preferably to 150° C. or more, and still more preferably 250° C. or more. The maximum temperature thereof is suitably about 300° C.

In the calender treatment using a metal surface, a pair of calendering rollers, in which at least one roller is a metal roller, may be used.

Examples of such calendering rollers are soft calendering rollers in combination of a metal roller and a synthetic resin roller, and machine calendering rollers having a pair of metal rollers. Of these, soft calendering rollers are preferred. In particular, a long nip shoe calender in combination of a metal roller and a shoe roller putting a synthetic resin belt between, is preferable from the viewpoint of a long nip width of 50 mm to 270 mm which is capable of increasing the contact surface area of the raw paper and the rollers.

The above calender treatments may be performed separately, or in combination.

Regardless of the type of calender apparatus, the calender treatment is preferably performed to subject the image-forming surface to come in contact with the metal rollers, and more preferably performed to subject it to come in contact with the metal rollers at a surface temperature of 110° C. or more. It is still more preferably performed to subject it to come in contact with the metal rollers at a temperature of 150° C. or more. If the image-forming surface does not come in contact with the metal rollers when the paper is passed through in the calender treatment, the raw paper density does not increase and smoothness does not fully improve, so a high quality image as good as silver photography cannot be formed.

The nip pressure when the raw paper is subjected to soft calender treatment may, for example, be 100 kN/m or more, and preferably 100 kN/m to 600 kN/m.

(Process for Manufacturing the Recording Material Support)

The process for manufacturing the recording material support is a manufacturing process of a recording material support comprising raw paper. In the process for manufacturing the recording material support of the present invention, a coating solution is applied on a surface of the raw paper, where a image-forming layer is provided, and thereafter a calender treatment is performed on the raw paper.

The coating solution containing at least one surface-treating agent selected from a soap-free latex and soap-free emulsion is preferably applied to a surface of the raw paper, where an image-forming layer is provided, with a coverage of 0.5 g/m$^2$ to 10 g/m$^2$ in terms of solids.

The calender treatment is calender treatment using a calender having a metal roller with a surface temperature of 110° C. or more. The calender treatment is preferably performed using at least one set of calenders, and at a surface temperature of 150° C. or more.

According to the process for manufacturing the recording material support of the present invention, a recording material support having excellent surface smoothness and water resistance can be efficiently manufactured.

(Recording Material)

The recording material of the present invention comprises a recording material support comprising raw paper and an image-forming layer thereon, and the recording material support of the present invention is used as the aforesaid the recording material support.

The image-forming layer is equivalent to a photographic emulsion layer, which provides the colors of YMC (yellow, magenta and cyan) in the case of silver photography. In the case of an inkjet, it is equivalent to an ink-receiving layer, which receives and retains the ink. In the case of electrophotography, it is equivalent to a toner image-receiving layer.

The recording material can differs according to the use and the type. Examples thereof include an electrophotographic image-receiving material, a thermosensitive color recording material, an ink-jet recording material, a sublimation transfer image-receiving material, a silver photographic photosensitive material, a heat transfer image-receiving material, and the like.

Hereafter, these recording materials will be described in detail.

<Electrophotographic Image-receiving Material>

The electrophotographic image-receiving material comprises the recording material support of the present invention and at least one toner image-receiving layer provided thereon. The electrophotographic image-receiving material may further comprise other suitably selected layers, if necessary, for example, a surface protective layer, an intermediate layer, an undercoat, a cushion layer, a charge control (inhibiting) layer, a reflecting layer, a tint adjusting layer, a storage ability improving layer, an anti-adhering layer, an anti-curl layer or smoothing layer. Each of these layers may have a single layer structure or multilayer structure.

[Toner Image-receiving Layer]

The above-mentioned toner image-receiving layer is a toner image-receiving layer, for which receives a color or black toner and form an image. This toner image-receiving layer has functions to receive toner, which forms an image, from a developing drum or an intermediate transfer body due to (static) electricity or pressure in a transfer step, and to fix it by heat or pressure in a fixing step.

An organic or inorganic pigment is preferably added to the toner image-receiving layer in the amount of less than 40% by mass, preferably less than 30% by mass and still more preferably less than 20% by mass, based on the mass of the thermoplastic resin forming the toner image-receiving layer, within limits which do not interfere with the desired object of the present invention. It is particularly preferred that it hardly contain the pigment. If the pigment content is less than 40% by mass, image quality and glossiness improve. Accordingly it is desirable to have the pigment content of less than 40% by mass.

In order to give the toner image-receiving layer a texture and an appearance approaching that of a photograph, it has a low optical transparency of preferably 78% or less, more preferably 73% or less, and still more preferably 72% or less.

The optical transmittance can be measured by separately forming a coating film of the same thickness on a polyethylene terephthalate film (100 μm), using a direct-reading haze meter (Suga Test Instruments HGM-2DP) on the coating film.

The material of the toner image-receiving layer contains at least a thermoplastic resin and, if necessary, contains various additives in order to improve the thermodynamic characteristics of the toner image-receiving layer, for example, a releasing agent, a plasticizer, a colorant, a filler, a crosslinking agent, a charge control agent, an emulsion, a dispersion and the like.

Thermoplastic Resin

There is no particular limitation on the above-mentioned thermoplastic resin and it can be selected according to the intended purpose, as long as it can change its shape at the fixing temperature and can receive toner. It is preferable if the thermoplastic resin is similar to a binder resin of toner. For example, it is preferable to use a polyester resin, styrene or a copolymer resin such as styrene-butylacrylate. It is more preferable to use 20% by mass or more of the polyester resin, styrene or the copolymer resin such as styrene-butylacrylate. Styrene, styrene-butylacrylate copolymer, styrene-acrylic acid ester copolymer and styrene-methacrylic acid ester copolymer are also preferred.

Specific examples of the thermoplastic resin include (a) resins containing ester bonds, (b) polyurethane resins, (c) polyamide resins, (d) polysulfone resins, (e) polyvinyl chloride resins, (f) polyvinyl butyral resins, (g) polycaprolactone resins, (h) polyolefin resins, and the like.

Examples of (a) resins containing ester bonds include polyester resins obtained by condensation of a dicarboxylic acid component, such as terephthalic acid, isophthalic acid, maleic acid, fumaric acid, phthalic acid, adipic acid, sebacic acid, azelaic acid, abietic acid, succinic acid, trimellitic acid, pyromellitic acid, or the like (in these dicarboxylic acid components, a sulfonic acid group, a carboxyl group, or the like may be substituted), with an alcohol component such as ethylene glycol, diethylene glycol, propylene glycol, bisphenol A, diether derivative of bisphenol A (e.g., ethyleneoxide biaddition product of bisphenol A, propylene oxide biaddition product of bisphenol A, or the like), bisphenol S, 2-ethyl cyclohexyl dimethanol, neopentyl glycol, cyclohexyldimethanol, glycerol, or the like (in these alcohol components, a hydroxyl group may be substituted); polyacrylic ester resins or polymethacrylic acid ester resins, such as polymethyl methacrylate, polybutylmethacrylate, polymethyl acrylate and polybutyl acrylate; polycarbonate resins; polyvinyl acetate resins; styrene acrylate resins; styrene-methacrylic acid ester copolymer resins; vinyltoluene acrylate resins; and the like.

Specific examples are given in Japanese Patent Application Laid-Open (JP-A) Nos. 59-101395, 63-7971, 63-7972, 63-7973 and 60-294862, and the like.

Commercially available products of the above-mentioned polyester resins are Bylon 290, Bylon 200, Bylon 280, Bylon 300, Bylon 103, Bylon GK-140 and Bylon GK-130 from Toyobo Co., Ltd; Tufton NE-382, Tufton U-5, ATR-2009 and ATR-2010 from Kao Corporation; Eritel UE3500, UE3210 and XA-8153 from Unitika Ltd; Polyester TP-220, R-188 from The Nippon Synthetic Chemical Industry Co., Ltd, or the like.

Commercially available products of the above-mentioned acrylic resins are SE-5437, SE-5102, SE-5377, SE-5649, SE-5466, SE-5482, HR-169, 124, HR-1127, HR-116, HR-113, HR-148, HR-131, HR-470, HR-634, HR-606, HR-607, LR-1065, 574, 143, 396, 637, 162, 469, 216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, BR-117 from Mitsubishi Rayon Ltd.; Esrec P SE-0020, SE-0040, SE-0070, SE-0100, SE-1010, SE-1035 from Sekisui Chemical Co., Ltd.; Himer ST95 and ST120 from Sanyo Chemical Industries, Ltd.; FM601 from Mitsui Chemicals, Inc, and the like.

The polyvinyl chloride resins (e) mentioned above may, for example, be a polyvinylidene chloride resin, a vinyl chloride-vinyl acetate copolymer resin, a vinyl chloride-vinyl propionate copolymer resin, and the like.

The polyvinyl butyral resins (f) mentioned above may be a polyol resin and a cellulose resin such as an ethyl cellulose resin, cellulose acetate resin, and the like. Commercially available products thereof are manufactured by Denki Kagaku Kogyo Kabushiki Kaisha and Sekisui Chemicals Ltd. The aforesaid polyvinyl butyral preferably contains 70% by mass or more of polyvinyl butyral, and preferably has an average polymerization degree of 500 or more, and more preferably an average polymerization degree of 1,000 or more. Commercially available products thereof are Denka Butyral 3000-1, 4000-2, 5000A and 6000C from Denki Kagaku Kogyo Kabushiki Kaisha; and Esrec BL-1, BL-2, BL-3, BL-S, BX-L, BM-1, BM-2, BM-5, BM-S, BH-3, BX-1, BX-7 from Sekisui Chemicals Ltd, or the like.

Further, examples of the polycaprolactone resins (g) include styrene-maleic anhydride resins, polyacrylonitrile resins, polyether. resins, epoxy resins, phenol resins, and the like.

Examples of the polyolefin resins (h) include polyethylene resins, polypropylene resins, copolymer resins of olefins such as ethylene, propylene, or the like with other vinyl monomers; acrylic resins, and the like.

These thermoplastic resins can be used either alone or in combination of two or more. Additionally, mixtures thereof and copolymers thereof can also be used.

It is preferred that the thermoplastic resin satisfies the physical properties of the toner image-receiving layer when the toner image-receiving layer is formed. It is more preferred that it satisfies the physical properties of the toner image-receiving layer when the resin is used alone. It is also preferred that two or more resins giving different physical properties to the toner image-receiving layer are used in combination.

It is preferred that the thermoplastic resin has a larger molecular weight than that of the thermoplastic resin used for the toner. However, this molecular weight relation may not always be desirable depending on the thermodynamic properties of the thermoplastic resin used for the toner and the resin used for the toner image-receiving layer. For example, if the softening temperature of the resin used for the toner image-receiving layer is higher than that of the thermoplastic resin used for the toner, it is preferred that the molecular weights are identical, or that the molecular weight of the resin used for the toner image-receiving layer is smaller.

It is preferred that the thermoplastic resin used is a mixture of resins with identical compositions having different average molecular weights. The relation of molecular weights of thermoplastic resins used as toners is disclosed in JP-A No. 08-334915.

The molecular weight distribution of the thermoplastic resin is preferably wider than the molecular weight distribution of the thermoplastic resin used in the toner.

It is preferred that the thermoplastic resin satisfies the physical properties disclosed in Japanese Patent Application Publication (JP-B) No. 05-127413, JP-A Nos. 08-194394, 08-334915, 08-334916, 09-171265, 10-221877, and the like.

Due to the reasons (i) and (ii) below, it is particularly preferred that the thermoplastic resin used in the toner image-receiving layer is an aqueous resin such as a water-soluble resin and a water-dispersible resin.

(i) There is no discharge of organic solvent in the coating and drying steps, which is excellent for the environment and provides easy working.

(ii) Many releasing agents such as wax are difficult to soluble in solvents at room temperature, so the releasing agents are often dispersed in a solvent (water, organic solvent) in advance. If they are dispersed in water, they are stable and highly suited to manufacturing steps. Further, if they are applied in an aqueous form, the wax easily bleeds on the surface in the coating and drying steps, and it is easy to obtain a releasing agent effect (offset-resistance, adhesion-resistance, and the like).

As long as it is a water-soluble resin or a water-degradable resin, the aqueous resin may have any composition, bond structure, molecular structure, molecular weight, molecular weight distribution or formation.

Examples of polymer groups which confer aqueous affinity include a sulfonyl group, a hydroxyl group, a carboxyl group, an amino group, an amide group, an ether group, and the like.

Examples of the aforesaid water-soluble resins are given on page 26 of "Research Disclosure" No. 17,643, page 651 of "Research Disclosure" No. 18,716, pp. 873–874 of "Research Disclosure" Nos. 307,105 and pp. 71–75 of JP-A No. 64-13546.

Specific examples thereof include a vinyl pyrrolidone-vinyl acetate copolymer, styrene-vinyl pyrrolidone copolymer, styrene-maleic anhydride copolymer, water-soluble polyester, water-soluble acryl, water-soluble polyurethane, water-soluble nylon, a water-soluble epoxy resin, and the like. Moreover, various types of gelatins may be selected according to the intended purpose from liming gelatin, acid-treated gelatin and deliming gelatin wherein the content of calcium, or the like, is reduced, and it is also preferable to use these in combination. Examples of the water-soluble polyesters are various plus coats from GaO Chemical Industries and the FineTex ES series from Dainippon Ink and Chemicals; Incorporated. Examples of the water-soluble acryls are the Julimer AT series from NIHON JUNYAKU CO., LTD., FineTex 6161 and K-96 from Dainippon Ink and Chemicals, Incorporated, and High Loss NL-1189 and BH-997L from SEIKO CHEMICAL INDUSTRIES CO., LTD.

Examples of water dispersible resins are water-dispersible type resins such as water-dispersible acrylate resin, water-dispersible polyester resin, water-dispersible polystyrene resin, water-dispersible urethane resin, or the like; and emulsions such as acrylic resin emulsion, polyvinyl acetate emulsion, SBR (styrene butadiene) emulsion, or the like. The resin can be conveniently selected from an aqueous dispersion of the aforesaid thermoplastic resins (a) to (h), their emulsions, or their copolymers, mixtures and cation-modified, or the like. Two or more of these sorts can be combined.

Examples of the aforesaid water-dispersible resins in the polyester class are the Byronal Series from Toyobo Co., Ltd, the Pethregin A Series from TAKAMATSU OIL&FAT CO., LTD, the Tufton UE Series from Kao Corporation, the Japan Synthetic Polyester WR Series, the Aeriel Series from Unitika Ltd., and the like. Examples in the acrylic class include the High Loss XE, KE and PE series from SEIKO CHEMICAL INDUSTRIES CO., LTD., the Julimer ET series from NIHON JUNYAKU CO., LTD., and the like.

It is preferred that the film-forming temperature (MFT) of the polymer is above room temperature for storage before printing, and is 100° C. or lower for fixing of toner particles.

The content of the thermoplastic resin is preferably 50% by mass or more relative to the total mass of the toner image-receiving layer, and more preferably 50% by mass to 90% by mass relative to the tonal mass of the toner image-receiving layer.

The thickness of the toner image-receiving layer is preferably ½ or more of used toner particle diameter, and more preferably 1 to 3 times of used toner particle diameter. It is particularly preferable to have a thickness disclosed in JP-A Nos. 05-216322, and 07-301939. Specifically, the thickness of the toner image-receiving layer is preferably 1 μm to 50 μm, and more preferably 5 μm to 15 μm.

Releasing Agent

The releasing agent is blended into the toner image-receiving layer, in order to prevent offset of the toner image-receiving layer. There is no particular limitation on the type of releasing agent of the present invention, as long as it dissolves, deposits onto the surface of the toner image-receiving layer, and is unevenly disposed on the surface of the toner image-receiving layer when heated to the fixing temperature, and forms a layer of releasing agent in the surface of the toner image-receiving layer when cooled and solidified.

The releasing agent having such effects is one or more type of releasing agents selected from a silicone compound, a fluorine compound, wax, and a matting agent. Preferably, the releasing agent is one or more type selected from silicone oil, polyethylene wax, carnauba wax, silicone particles and polyethylene wax particles.

The releasing agent used in the present invention may for example be a compound mentioned in "Properties and Applications of Waxes (Revised)" published by Saiwai Shobo, or in "The Silicone Handbook" published by THE NIKKAN KOGYO SHIMBUN. Also, the silicone compounds, fluorine compounds and wax used in the toners mentioned in Japanese Patent Application Publication (JP-B) No. 59-38581, Japanese Patent Application Publication (JP-B) No. 04-32380, Japanese Patent (P-B) No. 2838498, No. 2949558, Japanese Patent Application Laid-Open (JP-A) No. 50-117433, 52-52640, 57-148755, 61-62056, 61-62057, 61-118760, and Japanese Patent Application Laid-Open (JP-A) No. 02-42451, 03-41465, 04-212175, 04-214570, 04-263267, 05-34966, 05-119514, 06-59502, 06-161150, 06-175396, 06-219040, 06-230600, 06-295093, 07-36210, 07-43940, 07-56387, 07-56390, 07-64335, 07-199681, 07-223362, 07-287413, 08-184992, 08-227180, 08-248671, 08-248799, 08-248801, 08-278663, 09-152739, 09-160278, 09-185181, 09-319139, 09-319143, 10-20549, 10-48889, 10-198069, 10-207116, 11-2917, 11-44969, 11-65156, 11-73049 and 11-194542, may be used. These compounds can be used alone, or in combination of two or more.

Examples of the silicone compounds include non-modified silicone oils (specifically, dimethyl siloxane oil, methyl hydrogen silicone oil, phenyl methyl-silicone oil, or commercial products such as KF-96, KF-96L, KF-96H, KF-99, KF-50, KF-54, KF-56, KF-965, KF-968, KF-994, KF-995 and HIV AC F-4, F-5 from Shin-Etsu Chemical Co., Ltd.; SH200, SH203, SH490, SH510, SH550, SH710, SH704, SH705, SH7028A, SH7036, SM7060, SM7001, SM7706, SH7036, SH8710, SH1107 and SH8627 from Dow Corning Toray Silicone Co., Ltd.; and TSF400, TSF401, TSF404, TSF405, TSF431, TSF433, TSF434, TSF437, TSF450 Series, TSF451 series, TSF456, TSF458 Series, TSF483, TSF484, TSF4045, TSF4300, TSF4600, YF33 Series, YF-3057, YF-3800, YF-3802, YF-3804, YF-3807, YF-3897, XF-3905, XS69-A1753, TEX100, TEX101, TEX102, TEX103, TEX104, TSW831, and the like from GE Toshiba Silicones), amino-modified silicone oils (e.g., KF-857, KF-858, KF-859, KF-861, KF-864 and KF-880 from Shin-Etsu Chemical Co., Ltd., SF8417 and SM8709 from Dow Corning Toray Silicone Co., Ltd., and TSF4700, TSF4701, TSF4702, TSF4703, TSF4704, TSF4705, TSF4706, TEX150, TEX151 and TEX154 from GE Toshiba Silicones), carboxy-modified silicone oils (e.g., BY16-880 from Dow Corning Toray Silicone Co., Ltd., TSF4770 and XF42-A9248 from GE Toshiba Silicones), carbinol-modified silicone oils (e.g., XF42-B0970 from GE Toshiba Silicones), vinyl-modified silicone oils (e.g., XF40-A1987 from GE Toshiba Silicones), epoxy-modified silicone oils (e.g., SF8411 and SF8413 from Dow Corning Toray Silicone Co., Ltd.; TSF3965, TSF4730, TSF4732, XF42-A4439, XF42-A4438, XF42-A5041, XC96-A4462, XC96-A4463, XC96-A4464 and TEX170 from GE Toshiba Silicones), polyether-modified silicone oils (e.g., KF-351 (A), KF-352 (A), KF-353 (A), KF-354 (A), KF-355 (A), KF-615(A), KF-618 and KF-945 (A) from Shin-Etsu Chemical Co., Ltd.; SH3746, SH3771, SF8421, SF8419, SH8400 and SF8410 from Dow Corning Toray Silicone Co., Ltd.; TSF4440, TSF4441, TSF4445, TSF4446, TSF4450, TSF4452, TSF4453 and TSF4460 from GE Toshiba Silicones), silanol-modified silicone oils, methacryl-modified silicone oils, mercapto-modified silicone oils, alcohol-modified silicone oils (e.g., SF8427 and SF8428 from Dow Corning Toray Silicone Co., Ltd., TSF4750, TSF4751 and XF42-B0970 from GE Toshiba Silicones), alkyl-modified silicone oils (e.g., SF8416 from Dow Corning Toray Silicone Co., Ltd., TSF410, TSF411, TSF4420, TSF4421, TSF4422, TSF4450, XF42-334, XF42-A3160 and XF42-A3161 from GE Toshiba Silicones), fluorine-modified silicone oils (e.g., FS1265 from Dow Corning Toray Silicone Co., Ltd., and FQF501 from GE Toshiba Silicones), silicone rubbers and silicone fine particles (e.g., SH851, SH745U, SH55UA, SE4705U, SH502 UA&B, SRX539U, SE6770 U-P, DY38-038, DY38-047, Trefil F-201, F-202, F-250, R-900, R-902A, E-500, E-600, E-601, E-506, BY29-119 from Dow Corning Toray Silicone Co., Ltd.; Tospal 105, 120, 130, 145, 240 and 3120 from GE Toshiba Silicones), silicone-modified resins (specifically, olefin resins or polyester resins, vinyl resins, polyamide resins, cellulosic resins, phenoxy resins, vinyl chloride-vinyl acetate resins, urethane resins, acrylic resins, styrene-acrylic resins, compounds in which copolymerization resins thereof are modified by silicone, for example, Diaroma SP203V, SP712, SP2105 and SP3023 from Dainichiseika Color & Chemicals Mfg. Co., Ltd.; Modepa FS700, FS710, FS720, FS730 and FS770 from NOF CORPORATION; Simac US-270, US-350, US-352, US-380, US-413, US-450, Reseda GP-705, GS-30, GF-150 and GF-300 from TOAGOSEI CO,. LTD.; SH997, SR2114, SH2104, SR2115, SR2202, DCI-2577, SR2317, SE4001U, SRX625B, SRX643, SRX439U, SRX488U, SH804, SH840, SR2107 and SR2115 from Dow Corning Toray Silicone Co., Ltd., YR3370, TSR1122, TSR102, TSR108, TSR116, TSR117, TSR125A, TSR127B, TSR144, TSR180, TSR187, YR47, YR3187, YR3224, YR3232, YR3270, YR3286, YR3340, YR3365, TEX152, TEX153, TEX171 and TEX172 from GE Toshiba Silicones), and reactive silicone compounds (specifically, addition reaction type, peroxide-curing type and ultraviolet radiation curing type, examples include: TSR1500, TSR1510, TSR1511, TSR1515, TSR1520, YR3286, YR3340, PSA6574, TPR6500, TPR6501, TPR6600, TPR6702, TPR6604, TPR6700, TPR6701, TPR6705, TPR6707, TPR6708, TPR6710, TPR6712, TPR6721, TPR6722, UV9300, UV9315, UV9425, UV9430, XS56-A2775, XS56-A2982, XS56-A3075, XS56-A3969, XS56-A5730, XS56-A8012, XS56-B1794, SL6100, SM3000, SM3030, SM3200 and YSR3022 from GE Toshiba Silicones), and the like.

Examples of the fluorine compounds include fluorine oils (e.g., Daifluoryl #1, #3, #10, #20, #50, #100, Unidyne TG-440, TG-452, TG-490, TG-560, TG-561, TG-590, TG-652, TG-670U, TG-991, TG-999, TG-3010, TG-3020 and TG-3510 from Daikin Industries, Ltd.; MF-100, MF-110, MF-120, MF-130, MF-160 and MF-160E from Tohkem Products; S-111, S-112, S-113, S-121, S-131, S-132, S-141 and S-145 from Asahi Glass Co., Ltd.; and, FC-430 and FC-431 from DU PONT-MITSUI FLUORO-CHEMICALS COMPANY, LTD), fluoro rubbers (e.g., LS63U from Dow Corning Toray Silicone Co., Ltd.), fluorine-modified resins (e.g., Modepa F200, F220, F600, F2020, F600, F2020, F3035 from Nippon Oils and Fats; Diaroma FF203 and FF204 from Dai Nichi Pure Chemicals; Saflon S-381, S-383, S-393, SC-101, SC-105, KH-40 and SA-100 from Asahi Glass Co., Ltd.; EF-351, EF-352, EF-801, EF-802, EF-601, TFE, TFEA, TFEMA and PDFOH from Tohkem Products; and THV-200P from Sumitomo 3M), fluorine sulfonic acid compound (e.g., EF-101, EF-102, EF-103, EF-104, EF-105, EF-112, EF-121, EF-122A, EF-122B, EF-122C, EF-123A, EF-123B, EF-125M, EF-132, EF-135M, EF-305, FBSA, KFBS and LFBS from Tohkem Products), fluorosulfonic acid, and fluorine acid compounds or salts (specifically, anhydrous fluoric acid, dilute fluoric acid, fluoroboric acid, zinc fluoroborate, nickel fluoroborate, tin fluoroborate, lead fluoroborate, copper fluoroborate, fluorosilicic acid, fluorinated potassium titanate, perfluorocaprylic acid, ammonium perfluorooctanoate, and the like), inorganic fluorides (specifically, aluminum fluoride, potassium silicofluoride, fluorinated potassium zirconate, fluorinated zinc tetrahydrate, calcium fluoride, lithium fluoride, barium fluoride, tin fluoride, potassium fluoride, acid potassium fluoride, magnesium fluoride, fluorinated titanic acid, fluorinated zirconic acid, ammonium hexafluorinated phosphoric acid, potassium hexafluorinated phosphoric acid, and the like).

Examples of the wax include synthetic hydrocarbon, modified wax, hydrogenated wax, natural wax, and the like.

Examples of the synthetic hydrocarbon include polyethylene wax (e.g., polyron A, 393, and H481 from Chukyo Yushi Co., Ltd.; Sunwax E-310, E-330, E-250P, LEL-250, LEL-800, LEL-400P, from SANYO KASEI Co., Ltd.), polypropyrene wax (e.g., biscoal 330-P, 550-P, 660-P from SANYO KASEI Co., Ltd.), Fischer toropush wax (e.g., FT100, and FT-0070, from Nippon Seiro Co., Ltd.), an acid amide compound or an acid imide compound (specifically, stearic acid amide, anhydrous phthalic acid imide, or the like; for example, Cellusol 920, B-495, hymicron G-270, G-110, hydrine D-757 from Chukyo Yushi Co., Ltd.), and the like.

Examples of the modified wax include amine-modified polypropyrene (e.g., QN-7700 from SANYO KASEI Co., Ltd.), acryl-modified wax, fluorine-modified wax, olefin-modified wax, urethan wax (e.g., NPS-6010, and HAD-5090 from Nippon Seiro Co., Ltd.), alcohol wax (e.g., NPS-9210, NPS-9215, OX-1949, XO-020T from Nippon Seiro Co., Ltd.), and the like.

Examples of the hydrogenated waxes include cured castor oil (e.g., castor wax from Itoh Oil Chemicals Co., Ltd.), castor oil derivatives (e.g., dehydrated castor oil DCO, DCO Z-1, DCO Z-3, castor oil aliphatic acid CO-FA, ricinoleic acid, dehydrated castor oil aliphatic acid DCO-FA, dehydrated castor oil aliphatic acid epoxy ester D-4 ester, castor oil urethane acrylate CA-10, CA-20, CA-30, castor oil derivative MINERASOL S-74, S-80, S-203, S-42X, S-321, special castor oil condensation aliphatic acid MINERASOL RC-2, RC-17, RC-55, RC-335, special castor oil condensation aliphatic acid ester MINERASOL LB-601, LB-603, LB-604, LB-702, LB-703, #11 and L-164 from Itoh Oil Chemicals Co., Ltd.), stearic acid (e.g., 12-hydroxystearic acid from Itoh Oil Chemicals Co., Ltd.), lauric acid, myristic acid, palmitic acid, behenic acid, sebacic acid (e.g., sebacic acid from Itoh Oil Chemicals Co., Ltd.), undecylenic acid (e.g., undecylenic acid from Itoh Oil Chemicals Co., Ltd.), heptyl acids (heptyl acids from Itoh Oil Chemicals Co., Ltd.), maleic acid, high grade maleic oils (e.g., HIMALEIN DC-15, LN-10, 00-15, DF-20 and SF-20 from Itoh Oil Chemicals Co., Ltd.), blown oils (e.g., selbonol #10, #30, #60, R-40 and S-7 from Itoh Oil Chemicals Co., Ltd.) and synthetic waxes such as cyclopentadieneic oil (CP oil and CP oil-S from Itoh Oil Chemicals Co., Ltd.).

The natural wax is preferably at least one selected from vegetable wax, mineral wax, and petroleum wax. Of these, vegetable wax is more preferable.

Examples of the vegetable wax include carnuba waxes (e.g., EMUSTAR AR-0413 from Nippon Seiro Co., Ltd., and Cellusol 524 from Chukyo Yushi Co., Ltd.), castor oil (purified castor oil from Itoh Oil Chemicals Co., Ltd.), rapeseed oil, soybean oil, Japan tallow, cotton wax, rice wax, sugarcane wax, candelilla wax, Japan wax, jojoba oil, and the like. Of those, carnauba wax having a melting point of 70° C. to 95° C. is particularly preferable from viewpoints of providing an electrophotographic image-receiving material which is excellent in offset-resistance, adhesive resistance, transfer properties, glossiness, is less likely to cause cracking and splitting, and is capable of forming a high quality image.

Examples of the animal waxes are beeswax, lanolin, spermaceti, whale oil, wool wax, and the like.

Examples of the mineral wax include natural waxes such as montan wax, montan ester wax, ozokerite, ceresin, and the like; aliphatic acid esters (Sansosizer-DOA, AN-800, DINA, DIDA, DOZ, DOS, TOTM, TITM, E-PS, nE-PS, E-PO, E-4030, E-6000, E-2000H, E-9000H, TCP, C-1100, and the like, from New Japan Chemical Co., Ltd.), and the like. Of these, montan wax having a melting point of 70° C. to 95° C. is particularly preferable from viewpoints of providing an electrophotographic image-receiving material which is excellent in offset-resistance, adhesive resistance, transfer properties, brilliance, is less likely to cause cracking and splitting, and is capable of forming a high quality image.

Examples of the petroleum wax include a paraffin wax (e.g., Paraffin wax 155, 150, 140, 135, 130, 125, 120, 115, HNP-3, HNP-5, HNP-9, HNP-10, HNP-11, HNP-12, HNP-14G, SP-0160, SP-0145, SP-1040, SP-1035, SP-3040, SP-3035, NPS-8070, NPS-L-70, OX-2151, OX-2251, EMUSTAR-0384 and EMUSTAR-0136 from Nippon Seiro Co., Ltd.; Cellosol 686, 428, 651-A, A, H-803, B-460, E-172, 866, K-133, hydrin D-337 and E-139 from Chukyo Yushi Co., Ltd.; 1250 paraffin, 125° FD, 130° paraffin, 135° paraffin, 135° H, 140° paraffin, 140° N, 145° paraffin and paraffin wax M from Nippon Oil Corporation), or a microcrystalline wax (e.g., Hi-Mic-2095, Hi-Mic-3090, Hi-Mic-1080, Hi-Mic-1070, Hi-Mic-2065, Hi-Mic-1045, Hi-Mic-2045, EMUSTAR-0001 and EMUSTAR-042X from Nippon Seiro Co., Ltd.; Cellosol 967, M, from Chukyo Yushi Co., Ltd.; 155 Microwax and 180 Microwax from Nippon Oil Corporation), and petrolatum (e.g., OX-1749, OX-0450, OX-0650B, OX-0153, OX-261BN, OX-0851, OX-0550, OX-0750B, JP-1500, JP-056R and JP-011P from Nippon Seiro Co., Ltd.), and the like.

The content of the natural wax in the toner receiving layer (a surface) is preferably 0.1 g/m$^2$ to 4 g/m$^2$, and more preferably 0.2 g/m$^2$ to 2 g/m$^2$. If the content is less than 0.1 g/m$^2$, the offset-resistance and the adhesive resistance deteriorate. If the content is more than 4 g/m$^2$, the quality of an image may deteriorate because of the excessive amount of wax.

The melting point of the natural wax is preferably 70° C. to 95° C., and more preferably 75° C. to 90° C., from a viewpoint of offset-resistance and paper transfer properties.

The matting agent can be selected from any known matting agent in the art. Solid particles used as matting agents can be classified into inorganic particles and organic particles. Specifically, the inorganic matting agents may be oxides (e.g., silicon dioxide, titanium oxide, magnesium oxide, aluminum oxide), alkaline earth metal salts (e.g., barium sulfate, calcium carbonate, and magnesium sulfate), silver halides (e.g., silver chloride, and silver bromide), glass, and the like.

Examples of the inorganic matting agents can be found, for example, in West German Patent No. 2529321, UK Patent Nos. 760775, 1260772, and U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

Materials of the aforesaid organic matting agent include starch, cellulose ester (e.g., cellulose-acetate propionate), cellulose ether (e.g., ethyl cellulose) and a synthetic resin. The synthetic resin is preferably insoluble or hardly soluble in water. Examples of the synthetic resins being insoluble or hardly soluble in water, include poly(meta)acrylic acid esters (e.g., polyalkyl(meta)acrylate, polyalkoxyalkyl(meta) acrylate, polyglycidyl(meta)acrylate), poly(meta) acrylamide, polyvinyl ester (e.g., polyvinyl acetate), polyacrylonitrile, polyolefins (e.g., polyethylene), polystyrene, benzoguanamine resins, formaldehyde condensation polymer, epoxy resins, polyamide, polycarbonate, phenolic resins, polyvinyl carbazole and polyvinylidene chloride.

Copolymers which combine the monomers used in the above polymers, may also be used.

In the case of the aforesaid copolymers, a small amount of hydrophilic repeating units may be included. Examples of. monomers which form a hydrophilic repeated unit include acrylic acid, methacrylic acid, a, P-unsaturated dicarboxylic acid, hydroxyalkyl(meta)acrylate, sulfoalkyl (meta)acrylate and styrene sulfonic acid.

Examples of the organic matting agents can be found, for example, in UK Patent No. 1055713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821, and 57-14835.

Also, two or more types of solid particles may be used in combination. The average particle size of the solid particles may conveniently be, for example, 1 μm to 100 μm, and is more preferably 4 μm to 30 μm. The usage amount of the solid particles may conveniently be 0.01 g/m$^2$ to 0.5 g/m$^2$, and is more preferably 0.02 g/m$^2$ to 0.3 g/m$^2$.

The releasing agent added to the toner image-receiving layer of the present invention may also comprise different derivatives thereof, oxides, refined products and mixtures. These may also have reactive substituents.

The melting point (° C.) of this releasing agent is preferably 70° C. to 95° C., and more preferably 75° C. to 90° C. from the viewpoints of offset-resistance and paper transport properties.

The releasing agent is also preferably a water-dispersible releasing agent, from the viewpoint of compatibility when a water-dispersible thermoplastic resin is used as the thermoplastic resin of the toner image-receiving layer.

The content of the releasing agent in the toner image-receiving layer is preferably 0.1% by mass to 10% by mass, more preferably 0.3% by mass to 8.0% by mass and still more preferably 0.5% by mn ass to 5.0% by mass.

Plasticizer

The plasticizers known in the art may be used without any particular limitation. These plasticizers have the effect of adjusting the fluidity or softening of the toner image-receiving layer due to heat and/or pressure.

The plasticizer may be selected by referring to "Chemical Handbook", (Chemical Institute of Japan, Maruzen), "Plasticizers—their Theory and Application", (ed. Kohichi Murai, Saiwai Shobo), "The Study of Plasticizers, Part 1" and "The Study of Plasticizers, Part 2" (Polymer Chemistry Association), or "Handbook of Rubber and Plastics Blending Agents" (ed. Rubber Digest Co.), or the like.

Some of the plasticizers are listed as high boiling organic solvents, heat solvents, or the like. Examples of the plasticizers include esters (e.g., phthalic esters, phosphate esters, aliphatic acid esters, abiethyne acid ester, abietic acid ester, sebacic acid esters, azelinic ester, benzoates, butylates, epoxy aliphatic acid esters, glycolic acid esters, propionic acid esters, trimellitic acid esters, citrates, sulfonates, carboxylates, succinic acid esters, maleates, fumaric acid esters, phthalic esters, stearic acid esters, and the like), amides (e.g., aliphatic acid amides and sulfoamides), ethers, alcohols, lactones, polyethyleneoxy compounds, disclosed in JP-A Nos. 59-83154, 59-178451, 59-178453, 59-178454, 59-178455, 59-178457, 62-174754, 62-245253, 61-209444, 61-200538, 62-8145, 62-9348, 62-30247, 62-136646, 62-174754, 62-245253, 61-209444, 61-200538, 62-8145, 62-9348, 62-30247, 62-136646 and 02-235694, or the like.

The aforesaid plasticizers can be mixed into the resin.

The plasticizers may be polymers having relatively low molecular weight. In this case, it is preferred that the molecular weight of the plasticizer is lower than the molecular weight of the binder resin to be plasticized. Preferably the plasticizers have a molecular weight of 15,000 or less, or more preferably 5,000 or less. Further, oligomers may also be used as plasticizers. Apart from the compounds mentioned above, there are products such as, for example, Adecasizer PN-170 and PN-1430 from Asahi Denka Co., Ltd.; PARAPLEX-G-25, G-30 and G-40 from C. P. Hall; and, rosin ester 8 L-JA, ester R-95, pentalin 4851, FK 115,4820, 830, Ruizol 28-JA, Picolastic A75, Picotex LC and Cristalex 3085 from Rika Hercules, Inc, and the like.

The aforesaid plasticizer can be used as desired to relax stress and distortion (physical distortions of elasticity and viscosity, and distortions of mass balance in molecules, binder main chains or pendant portions) which are produced when toner particles are embedded in the toner image-receiving layer.

The plasticizer may be dispersed as microparticles in the toner image-receiving layer, may be phase-separated on the micro level as islands, or may be completely mixed and dissolved in other components such as the binder.

The content of the plasticizer in the toner image-receiving layer is preferably 0.001% by mass to 90% by mass, more preferably 0.1% by mass to 60% by mass, and still more preferably 1% by mass to 40% by mass.

The plasticizer may be used for the purposes of adjusting slip properties (improved transportability due to decrease in friction), improving offset at a fixing part (separation of toner or layers onto the fixing part), adjusting curl balance or adjusting charge (forming a toner electrostatic image).

Colorant

Examples of the colorants include florescent whitening agents, white pigments, colored pigments, dyes, and the like.

The aforesaid florescent whitening agent has absorption in the near-ultraviolet region, and is a compound which emits fluorescence at 400 nm to 500 nm. The various florescent whitening agents known in the art may be used without any particular limitation. Examples of the florescent whitening agent include the compounds described in "The Chemistry of Synthetic Dyes" Volume V, Chapter 8 edited by KVeen-Rataraman. Specific examples thereof include stilbene compounds, coumarin compounds, biphenyl compounds, benzoxazoline compounds, naphthalimide compounds, pyrazoline compounds, carbostyryl compounds, and the like. Examples of these include white furfar-PSN, PHR, HCS, PCS, and B from Sumitomo Chemicals, UVITEX-OB from Ciba-Geigy, and the like.

Examples of the white pigments are the inorganic pigments described in "Fillers", (e.g., titanium oxide, calcium carbonate, and the like). Examples of the colored pigments include various pigments and azo pigments described in JP-A No. 63-44653, (e.g., azo lakes such as carmine 6B and red 2B, insoluble azo compounds such as monoazo yellow, disazo yellow, pyrazolo orange, Balkan orange, and condensed azo compounds such as chromophthal yellow and chromophthal red), polycyclic pigments (e.g., phthalocyanines such as copper phthalocyanine blue and copper phthalocyanine green), thioxadines such as thioxadine violet, isoindolinones such as isoindolinone yellow, surenes such as perylene, perinon, hulavanthoron and thioindigo, lake pigments (e.g., malachite green, rhodamine B, rhodamine G and Victoria blue B), and inorganic pigments (e.g., oxides, titanium dioxide and red ocher, sulfates such as precipitated barium sulfate, carbonates such as precipitated calcium carbonates, silicates such as water-containing silicates and anhydrous silicates, metal powders such as aluminum powder, bronze powder and zinc dust, carbon black, chrome yellow and Berlin blue), and the like.

These may be used either alone, or in combination of two or. Of these, titanium oxide is particularly preferred as the pigment.

The various dyes known in the art may be used as the aforesaid dye.

Examples of oil-soluble dyes include anthraquinone compounds, azo compounds, and the like.

Examples of water-insoluble dyes include vat dyes such as C.I.Vat violet 1, C.I.Vat violet 2, C.I.Vat violet 9, C.I.Vat violet 13, C.I.Vat violet 21, C.I.Vat blue 1, C.I.Vat blue 3, C.I.Vat blue 4, C.I.Vat blue 6, C.I.Vat blue 14, C.I.Vat blue 20 and C.I.Vat blue 35, or the like; disperse dyes such as C.I. disperse violet 1, C.I. disperse violet 4, C.I. disperse violet 10, C.I. disperse blue 3, C.I. disperse blue 7, C.I. disperse blue 58, or the like; and oil-soluble dyes such as C.I. solvent violet 13, C.I. solvent violet 14, C.I. solvent violet 21, C.I. solvent violet 27, C.I. solvent blue 11, C.I. solvent blue 12, C.I. solvent blue 25, C.I. solvent blue 55, or the like.

Colored couplers used in silver halide photography may also be preferably used.

The content of the colorant is identical to the above-mentioned content of the colorant.

Filler

The filler may be an organic or inorganic filler. Reinforcers for binder resins, bulking agents and reinforcements known in the art may be used. This filler may be selected by referring to "Handbook of Rubber and Plastics Additives" (ed. Rubber Digest Co.), "Plastics Blending Agents—Basics and Applications" (New Edition) (Taisei Co.), "The Filler Handbook" (Taisei Co.), or the like.

As the filler, various inorganic fillers (or pigments) can be used. Examples of the inorganic pigments include silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate, mullite, and the like. Silica and alumina are particularly preferred. These fillers may be used either alone or in combination of two or more. It is preferred that the filler has a small particle diameter. If the particle diameter is large, the surface of the toner image-receiving layer tends to become rough.

The silica includes spherical silica and amorphous silica. The silica may be synthesized by the dry method, wet method or aerogel method. The surface of the hydrophobic silica particles may also be treated by trimethylsilyl groups or silicone. Colloidal silica is preferred. The average particle diameter of the silica is preferably 200 nm to 5,000 nm.

The silica is preferably porous. The average particle diameter of porous silica is preferably 4 nm to 120 nm, and more preferably 4 nm to 90 nm. The average pore volume per mass of porous silica is preferably 0.5 ml/g to 3 ml/g.

The alumina includes anhydrous alumina and hydrated alumina. Examples of crystallized anhydrous aluminas which may be used are $\alpha$, $\beta$, $\gamma$, $\delta$, $\xi$, $\eta$, $\theta$, $\kappa$, $\rho$ or $\chi$. Hydrated alumina is preferred to anhydrous alumina. The hydrated alumina may be a monohydrate or trihydrate. Monohydrates include pseudo-boehmite, boehmite and diaspore. Trihydrates include gibbsite and bayerite. The average particle diameter of alumina is preferably 4 nm to 300 nm, and more preferably 4 nm to 200 nm. Porous alumina is preferred. The average pore size of porous alumina is preferably 50 nm to 500 nm. The average pore volume per mass of porous alumina is around 0.3 ml/g to 3 ml/g.

The alumina hydrate can be synthesized by the sol-gel method, in which ammonia is added to an aluminum salt solution to precipitate alumina, or by hydrolysis of an alkali aluminate. The anhydrous alumina can be obtained by dehydrating alumina hydrate by the action of heat.

It is preferred that the filler is 5 parts by mass to 2,000 parts by mass, relative to the dry mass of the binder in the layer where the filler is to be added.

Crosslinking Agent

The crosslinking agent can be added in order to adjust the storage stability or thermoplastic properties of the toner image-receiving layer. Examples of the crosslinking agent include compounds containing two or more reactive groups in the molecule, such as an epoxy group, an isocyanate group, an aldehyde group, an active halogen group, an active methylene group, an acetylene group and other reactive groups known in the art.

The crosslinking agent may also be a compound having two or more groups capable of forming bonds such as hydrogen bonds, ionic bonds, stereochemical bonds, or the like.

The crosslinking agent may be a compound known in the art such as a coupling agent for resins, a curing agent, a polymerizing agent, a polymerization promoter, a coagulant, a film-forming agent, a film-forming assistant, or the like. Examples of the coupling agent include chlorosilanes, vinylsilanes, epoxisilanes, aminosilanes, alkoxyaluminum chelates, titanate coupling agents, and the like. The examples further include other agents known in the art such as those mentioned in "Handbook of Rubber and Plastics Additives" (ed. Rubber Digest Co.).

Charge Control Agent

It is preferred that the toner image-receiving layer of the present invention contains a charge control agent to adjust toner transfer and adhesion, and to prevent charge adhesion. The charge control agent may be any charge control agent known in the art. Examples of the charge control agent include surfactants such as a cationic surfactant, an anionic surfactant, an amphoteric surfactant, a nonionic surfactant, or the like; polymer electrolytes, electroconducting metal oxides, and the like. Examples thereof include cationic charge inhibitors such as quaternary ammonium salts, polyamine derivatives, cation-modified polymethylmethacrylate, cation-modified polystyrene, or the like; anionic charge inhibitors such as alkyl phosphates, anionic polymers, or the like; and nonionic charge inhibitors such as polyethylene oxide, or the like. The examples are not limited thereto, however.

When the toner has a negative charge, it is preferred that the charge adjusting agent blended with the toner image-receiving layer is, for example, cationic or nonionic.

Examples of the electroconducting metal oxides include ZnO, $TiO_2$, $SnO_2$, $Al_2O_3$, $In_2O_3$, $SiO_2$, MgO, BaO, $MoO_3$, and the like. These electroconducting metal oxides may be used alone, or may be used in the form of a complex oxide. Moreover, the metal oxide may contain other elements. For example, ZnO may contain Al, In, or the like, $TiO_2$ may contain Nb, Ta, or the like, and $SnO_2$ may contain (or, dope) Sb, Nb, halogen elements, or the like.

Other Additives

The materials used to obtain the toner image-receiving layer may also contain various additives to improve image stability when output, or to improve stability of the toner image-receiving layer itself. Examples of the additives used for these purposes include antioxidants, age resistors, degradation inhibitors, ozone-degradation inhibitors, ultraviolet light absorbers, metal complexes, light stabilizers, preservatives, fungicide, and the like.

Examples of the antioxidants include chroman compounds, coumarane compounds, phenol compounds (e.g., hindered phenols), hydroquinone derivatives, hindered amine derivatives, spiroindan compounds, and the like. The antioxidants can be found, for example, in JP-A No. 61-159644.

Examples of the age resistors can be found in "Handbook of Rubber and Plastics Additives", Second Edition (1993, Rubber Digest Co.), pp. 76–121.

Examples of the ultraviolet light absorbers include benzotriazo compounds (described in U.S. Pat. No. 3,533,794), 4-thiazolidone compounds (described in U.S. Pat. No. 3,352,681), benzophenone compounds (described in JP-A No. 46-2784), ultraviolet light absorbing polymers (described in JP-A No. 62-260152).

Examples of the metal complexes can be found in U.S. Pat. Nos. 4,241,155, 4,245,018, 4,254,195, and JP-A Nos. 61-88256, 62-174741, 63-199248, 01-75568, 01-74272.

The ultraviolet light absorbers and the light stabilizers can be found in "Handbook of Rubber and Plastics Additives", Second Edition (1993, Rubber Digest Co.), pp.122–137 may also be used.

Photographic additives known in the art may also be added to the material used to obtain the toner image-receiving layer as described above. Examples of the photographic additives can be found in "the Journal of Research Disclosure" (hereafter referred to as RD) No. 17643 (December 1978), No. 18716 (November 1979) and No. 307105 (November 1989). The relevant sections are shown below.

| Type of additive | RD17643 | RD18716 | RD307105 |
|---|---|---|---|
| 1. Whitener | p 24 | p 648, right-hand column | p 868 |
| 2. Stabilizer | p 24–25 | p 649, right-hand column | p 868–870 |
| 3. Light absorbers (ultraviolet light absorbers) | p 25–26 | p 649, right-hand column | p 873 |
| 4. Pigment image stabilizers | p 25 | p 650, right-hand column | p 872 |
| 5. Filmhardening agents | P 26 | p 651, left-hand column | p 874–875 |
| 6. Binders | P 26 | p 651, left-hand colum | p 873–874 |
| 7. Plasticizers, lubricants | P 27 | p 650, right-hand column | p 876 |
| 8. Coating assistants (crosslinking agents) | p 26–27 | p 650, right-hand column | p 875–876 |
| 9. Antistatic agents | p 27 | p 650, right-hand column | p 876–877 |
| 10. Matting agents | | | p 878–879 |

The toner image-receiving layer is formed by applying a coating solution which contains the polymer used for the toner image-receiving layer with a wire coater or the like to the support, and drying the coating solution.

The toner image-receiving layer is coated so that the amount of coating in mass after drying is preferably 1 $g/m^2$ to 20 $g/m^2$, and more preferably 4 $g/m^2$ to 15 $g/m^2$.

There is no particular limitation on the thickness of the toner image-receiving layer. However, it is preferably 1 μm to 30 μm, and more preferably 2 μm to 20 μm.

[Physical Properties of Toner Image-receiving Layer]

The glossiness of the surface of toner image-receiving layer is preferably 20 or more, and more preferably 30 or more.

The surface of toner image-receiving layer preferably has high glossiness. The 45° glossiness over the whole region from the white areas where there is no toner to the black areas of maximum density, is preferably 60 or more, more preferably 75 or more, and still more preferably 90 or more. However, the gloss is preferably less than 110. If 110 is exceeded, it resembles a metallic gloss which is undesirable as an image. The gloss can be measured based on JIS Z 8741.

The surface of toner image-receiving layer preferably has high smoothness. As an indicator of smoothness, the arithmetic mean surface roughness (Ra) over the whole region from the white areas where there is no toner to the black areas of maximum density, is preferably 2 μm or less, more preferably 1 μm or less and still more preferably 0.5 μm or less.

The arithmetic mean surface roughness can be measured based on JIS B 0601, B 0651 and B 0652.

The reflectance of the surface of toner image-receiving material to the light in the wavelength range of 450 nm to 700 nm is 80% or more, preferably 100% or more, and the difference between the maximum reflectance and minimum reflectance to the light of this wavelength range is preferably 5% or less.

In this case, electrophotographic image-receiving materials having a high reflectance near the wavelength of 400 nm to 450 nm emit strong fluorescence, which is preferred.

The reflectance can be measured with a Hitachi color analyzer C-2000.

The 180° peeling strength of the toner image-receiving layer at the temperature of fixing by the fixing member is preferably 0.1N/25 mm or less, and more preferably 0.041 N/25 mm or less. The 180° peeling force can be measured based on the method described in JIS K6887 using the surface material of the fixing member.

It is preferred that the toner image-receiving layer has one of the following physical properties, more preferred that it has several of the following physical properties, and most preferred that it has all of the following physical properties.

(1) Tm (melting temperature) of the toner image-receiving layer is 30° C. or higher, and Tm of the toner +20° C., or less.

(2) The temperature at which the viscosity of the toner image-receiving layer is $1\times10^5$ cp is 40° C. or higher, and lower than the corresponding temperature for the toner.

(3) At a fixing temperature of the toner image-receiving layer, the storage elasticitic modulus (G') is $1\times10^2$ Pa to $1\times10^5$ Pa, and the loss elasticitic modulus (G") is $1\times10^2$ Pa to $1\times10^5$ Pa.

(4) The loss tangent (G'/G"), which is the ratio of the loss elasticitic modulus (G") and the storage elasticitic modulus (G') at a fixing temperature of the toner image-receiving layer, is 0.01 to 10.

(5) The storage elastic modulus (G') at a fixed temperature of the toner image-receiving layer is in the range of −50 to +2500, relative to the storage elasticitic modulus (G") at a fixing temperature of the toner.

(6) The inclination angle on the toner image-receiving layer of the molten toner is 50° or less, and particularly preferably 40° or less. The toner image-receiving layer preferably satisfies the physical properties described in Japanese Patent (JP-B) No. 2788358, and JP-A Nos. 07-248637, 08-305067 and 10-239889.

It is preferred that the surface electrical resistance of the toner image-receiving layer is within the range of $1\times10^6$ $\Omega/cm^2$ to $1\times10^{15}$ $\Omega/cm^2$ (under conditions of 25° C., 65% RH).

If the surface electrical resistance is less than $1\times10^6$ $\Omega/cm^2$, the toner amount transferred to the toner image-receiving layer is insufficient, and the density of the toner image obtained may be too low. On the other hand, if the surface electrical resistance exceeds $1\times10^{15}$ $\Omega/cm^2$, more charge than necessary is produced during transfer. Therefore, toner is transferred insufficiently, image density is low and static electricity develops causing dust to adhere during handling of the electrophotographic image-receiving material, or misfeed, overfeed, discharge marks or toner transfer dropout may occur.

The aforesaid surface electrical resistances were measured based-on JIS K 6911. The sample was left with air-conditioning for 8 hours or more at a temperature of 20° C. and the humidity of 65%. Measurements were made using an R8340 manufactured by Advantest Ltd., under the same environmental conditions after giving an electric current for 1 minute at an applied voltage of 100 V.

[Other Layers]

Other layers may include, for example, a surface protective layer, a backing layer, a contact improving layer, an intermediate layer, an undercoat, a cushion layer, a charge control (inhibiting) layer, a reflecting layer, a tint adjusting layer, a storage ability improving layer, an anti-adhering layer, an anti-curl layer, a smoothing layer, and the like. These layers may be used either alone, or in combination of two or more.

Surface Protective Layer

A surface protective layer is provided on the surface of the toner image-receiving layer to protect the surface of the electrophotographic image-receiving material, to improve storage properties, to improve ease of handling, to facilitate writing, to improve transferring within an equipment, to confer anti-offset properties, or the like. The surface protective layer may comprise one layer, or two or more layers. In the surface protective layer, various thermoplastic resins or thermocuring resins may be used as binders, and are preferably the same types of resins as those of the toner image-receiving layer. However, the thermodynamic properties and electrostatic properties are not necessarily identical to those of the toner image-receiving layer, and may be individually optimized.

The surface protective layer may comprise the various additives described above which can be used for the toner image-receiving layer. In particular, in addition to the releasing agents used in the present invention, the surface protective layer may include other additives, for example matting agents or the like. The matting agents may be any of those used in the related art.

From the viewpoint of fixing properties, it is preferred that the outermost surface layer of the electrophotographic image-receiving material (which refers to, for example, the surface protective layer, if formed) has good compatibility with the toner. Specifically, it is preferred that the contact angle with molten toner is for 0° to 40°.

Backing Layer

It is preferred that, in the electrophotographic image-receiving material, a backing layer is provided on the opposite side of the support to the toner image-receiving layer in order to confer undersurface output compatibility, and to improve undersurface output image quality, curl balance and transferring properties within equipment.

There is no particular limitation on the color of the backing layer. However, if the electrophotographic image-receiving material is a double-sided output image-receiving sheet where an image is formed also on the undersurface, it is preferred that the backing layer is also white. It is preferred that the whiteness and spectral reflectance are 85% or more, as in the case of the upper surface.

To improve two-sided output compatibility, the backing layer may have an identical structure to that of the toner image-receiving layer. The backing layer may comprise the various additives described hereinafter. Of these additives, matting agents and charge control agents are particularly suitable. The backing layer may be a single layer, or may have a laminated structure comprising two or more layers.

Further, if releasing oil is used for the fixing roller, or the like, to prevent offset during fixing, the backing layer may have oil absorbing properties.

Contact Improving Layer

In the electrophotographic image-receiving material, it is preferred to form a contact improving layer in order to improve the contact between the support and the toner image-receiving layer. The contact improving layer may contain the various additives described above. Of those, the crosslinking agents are particularly preferred to be blended in the contact improving layer. Furthermore, to improve accepting properties to toner, it is preferred that the electrophotographic image-receiving material further comprises a cushion layer between the contact improving layer and the toner image-receiving layer.

Intermediate Layer

An intermediate layer may be formed, for example, between the support and the contact improving layer, the contact improving layer and the cushion layer, the cushion layer and the toner image-receiving layer, or the toner image-receiving layer and the storage ability improving layer. In an electrophotographic image-receiving material comprising a support, a toner image-receiving layer and an intermediate layer, the intermediate layer may be provided, for example, between the support and toner image-receiving layer.

The thickness of the electrophotographic image-receiving material is not limited and adjusted depending on the intented purpose, but preferably 50 μm to 350 μm, and more preferably 100 μm to 280 μm.

<Toner>

In the electrophotographic image-receiving material of the present invention, the toner image-receiving layer receives toner during printing or copying.

The toner contains at least a binder resin and a colorant, but may contain releasing agents and other components, if necessary.

Toner Binder Resin

Examples of the binder resin include homopolymers and copolymers of vinyl monomers such as: styrenes such as styrene, parachlorostyrene, or the like; vinyl esters such as vinyl naphthalene, vinyl chloride, vinyl bromide, vinyl fluoride, vinyl acetate, vinyl propioniate, vinyl benzoate, vinyl butyrate, or the like; methylene aliphatic carboxylates such as methyl acrylate, ethyl acrylate, n-butyl acrylate, isobutyl acrylate, dodecyl acrylate, n-octyl acrylate, 2-chloroethyl acrylate, phenyl acrylate, α-methyl chloroacrylate, methyl methacrylate, ethyl methacrylate, butyl acrylate, or the like; vinyl nitriles such as acryloniotrile, methacrylonitrile, acrylamide, or the like; vinyl ethers such as vinyl methyl ether, vinyl ethyl ether, vinyl isobutyl ether, or the like; N-vinyl compounds such as N-vinyl pyrrole, N-vinylcarbazole, N-vinyl indole, N-vinyl pyrrolidone, or the like; and vinyl carboxylic acids such as methacrylic acid, acrylic acid, cinnamic acid, or the like. In addition, various polyesters may be used, and various waxes may be used in combination.

Of these resins, it is preferable to use a resin of the same type as the resin used for the toner image-receiving layer.

Toner Colorants

The colorants generally used in the art can be used without limitation. Examples of the colorants include carbon black, chrome yellow, Hansa yellow, benzidine yellow, thuren yellow, quinoline yellow, permanent orange GTR, pyrazolone orange, Balkan orange, watch young red, permanent red, brilliant carmin 3B, brilliant carmin 6B, dippon oil red, pyrazolone red, lithol red, rhodamine B lake, lake red C, rose bengal, aniline blue, ultramarine blue, chalco oil blue, methylene blue chloride, phthalocyanine blue, phthalocyanine green, malachite green oxalate, or the like. Various dyes may also be added such as acridine, xanthene, azo, benzoquinone, azine, anthraquinone, thioindigo, dioxadine, thiadine, azomethine, indigo, thioindigo, phthalocyanine, aniline black, polymethine, triphenylmethane, diphenylmethane, thiazine, thiazole, xanthene, or the like. These colorants may be used either alone, or in combination of a plurality of colorants.

It is preferred that the content of the colorant is 2% by mass to 8% by mass. If the content of colorant is more than 2% by mass, the coloration does not become weaker. If it is 8% by mass or less, transparency does not deteriorate.

Toner Releasing Agent

The releasing agent may be in principle any of the waxes known in the art. Polar waxes containing nitrogen such as highly crystalline polyethylene wax having relatively low molecular weight, Fischertropsch wax, amide wax, urethane wax, and the like are particularly effective. For polyethylene wax, it is particularly effective if the molecular weight is 1,000 or less, and is more preferably if the molecular weight is 300 to 1,000.

Compounds containing urethane bonds have a solid state due to the strength of the cohesive force of the polar groups even if the molecular weight is low, and as the melting point can be set high in view of the molecular weight, they are suitable. The preferred molecular weight is 300 to 1,000. The initial materials may be selected from various combinations such as a diisocyane acid compound with a monoalcohol, a monoisocyanic acid with a mono-alcohol, dialcohol with mono-isocyanic acid, tri-alcohol with a monoisocyanic acid, and a triisocyanic acid compound with a mono-alcohol. To prevent the increase of molecular weight, it is preferred to use a combination of compounds with polyfunctional groups and monofunctional groups, and it is important to use equivalent amounts of functional groups.

Among the initial materials, examples of the monoisocyanic acid compounds are dodecyl isocyanate, phenyl isocyanate and derivatives thereof, naphthyl isocyanate, hexyl isocyanate, benzyl isocyanate, butyl isocyanate, allyl isocyanate, and the like.

Examples of the diisocyanic acid compounds include tolylene diisocyanate 4,4' diphenylmethane diisocyanate, toluene diisocyanate, 1,3-phenylene diisocyanate, hexamethylene diisocyanate, 4-methyl-m-phenylene diisocyanate, isophorone diisocyanate, and the like.

Examples of the mono-alcohols include ordinary alcohols such as methanol, ethanol, propanol, butanol, pentanol, hexanol, heptanol, and the like.

Among the initial materials, examples of the di-alcohols include numerous glycols such as ethylene glycol, diethylene glycol, triethylene glycol, trimethylene glycol, or the like; and examples of the tri-alcohols include trimethylol propane, triethylol propane, trimethanolethane, and the like. The present invention is not necessarily limited these examples, however.

These urethane compounds may be mixed with the resin or the colorant during kneading, as an ordinary releasing agent, and used also as a kneaded-crushed toner. Further, in a case of using an emulsion polymerization cohesion scorification toner, the urethane compounds may be dispersed in water together with an ionic surfactant, polymer acid or polymer electrolyte such as a polymer base, heated above the melting point, and converted to fine particles by applying an intense shear in a homogenizer or pressure discharge dispersion machine to manufacture a releasing agent particle dispersion of 1 μm or less, which can be used together with a resin particle dispersion, colorant dispersion, or the like.

Toner, Other Components

The toner may also contain other components such as internal additives, charge control agents, inorganic particles, or the like. Examples of the internal additives include metals such as ferrite, magnetite, reduced iron, cobalt, nickel manganesite, or the like; alloys or magnetic bodies such as compounds containing these metals.

Examples of the charge control agents include dyes such as quaternary ammonium salt, nigrosine compounds, dyes made from complexes of aluminum, iron and chromium, or triphenylmethane pigments. The charge control agent can be selected from the ordinary charge control agent. Materials which are hard to become solved in water are preferred from the viewpoint of controlling ionic strength which affects cohesion and stability during melting, and the viewpoint of less waste water pollution.

The inorganic fine particles may be any of the external additives for toner surfaces generally used, such as silica, alumina, titania, calcium carbonate, magnesium carbonate, tricalcium phosphate, or the like. It is preferred to disperse these with an ionic surfactant, polymer acid or polymer base.

Surfactants can also be used for emulsion polymerization, seed polymerization, pigment dispersion, resin particle dispersion, releasing agent dispersion, cohesion or stabilization thereof. Examples of the surfactants include anionic surfactants such as sulfuric acid ester salts, sulfonic acid salts, phosphoric acid esters, soaps, or the like; cationic surfactants such as amine salts, quaternary ammonium salts, or the like. It is also effective to use non-ionic surfactants such as polyethylene glycols, alkylphenol ethylene oxide adducts, polybasic alcohols, or the like. These may generally be dispersed by a rotary shear homogenizer or a ball mill, sand mill, dyno mill, or the like, all of which contain the media.

The toner may also contain an external additive, if necessary. Examples of the additive include inorganic powder, organic particles, and the like. Examples of the inorganic particles include $SiO_2$, $TiO_2$, $Al_2O_3$, CuO, ZnO, $SnO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, MgSO4, and the like. Examples of the organic particles include aliphatic acids, derivatives thereof, and the like, powdered metal salts thereof, and resin powders of such as fluorine resin, polyethylene resin, acrylic resin, or the like. The average particle diameter of the powder may be, for example, 0.01 μm to 5 μm, and is more preferably 0.1 μm to 2 μm.

There is no particular limitation on the process of manufacturing the toner, but it is preferably manufactured by a process comprising the steps of (i) forming cohesive particles in a dispersion of resin particles to manufacture a cohesive particle dispersion, (ii) adding a fine particle dispersion to the aforesaid cohesive particle dispersion so that the fine particles adhere to the cohesive particles, thus forming adhesion particles, and (iii) heating the aforesaid adhesion particles which melt to form toner particles.

Toner Physical Properties

It is preferred that the volume average particle diameter of the toner is from 0.5 μm to 10 μm.

If the volume average particle diameter of the toner is too small, it may have an adverse effect on handling of the toner (supplementation, cleaning properties, fluidability, or the like), and particle productivity may decline. On the other hand, if the volume average particle damage is too large, it may have an adverse effect on image quality and resolution due to granulariness and transfer properties.

It is preferred that the toner satisfies the aforesaid toner volume average particle diameter range, and that the volume average particle distribution index (GSDv) is 1.3 or less.

It is preferred that the ratio (GSDv/GSDn) of the volume average polymer distribution index (GSDv) and the number average particle distribution index (GSDn) is at least 0.95.

It is preferred that the toner satisfies the aforesaid volume average particle diameter range, and that the average value of the shape coefficient expressed by the following equation is 1.00 to 1.50.

$$\text{Shape coefficient}=(\pi\times L^2)/(4\times S)$$

(where, L is the maximum length of the toner particles, and S is the projection surface area of a toner particle).

If the toner satisfies the above conditions, it has a desirable effect on image quality, and in particular, granulariness and resolution. Also, there is less risk of dropout and blur accompanying transfer, and less risk of adverse effect on handling properties even if the average particle diameter is small.

The storage elasticity modulus G' (measured at an angular frequency of 10 rad/sec) of the toner itself at 150° C. is 10 Pa to 200 Pa, which is suitable for improving image quality and preventing offset in a fixing step.

[Process for Image Formation]

In the process for image formation, after forming a toner image on the electrophotographic image-receiving material, the image-forming surface of the electrophotographic image-receiving material is pressurized and heated by a fixing belt and roller, cooled, and separated from the fixing belt.

The transfer method may be that usually used in electrophotography, for example, the direct transfer method wherein the image formed on the developing roller is directly transferred to the electrophotographic image-receiving material, or the intermediate belt method wherein it is first transferred to an intermediate transfer belt, or the like, and then transferred to the electrophotographic image-receiving material. From the viewpoint of environmental stability and high image quality, the intermediate transfer belt method is the method of choice.

Regarding the electrophotographic image-receiving material of the present invention, the toner transferred to the electrophotographic image-receiving material is fixed on the electrophotographic image-receiving material using an electrophotographic apparatus comprising a fixing belt. The belt fixing method may for example be the oilless type as described in JP-A No. 11-352819, or the method wherein a second transfer and fixing are realized simultaneously as described in JP-A Nos. 11-231671 and 05-341666. The electrophotographic apparatus comprising a fixing belt may be an electrophotographic apparatus comprising for example at least a heating and pressurizing part which can melt and pressurize the toner, a fixing belt which can transport the electrophotographic image-receiving material carrying toner, while in contact with the toner image-receiving layer, and a cooling part which can cool the heated electrophotographic image-receiving material while it is still adhering to the fixing belt. By using the electrophotographic image-receiving material comprising the toner image-receiving layer in the electrophotographic apparatus comprising the fixing belt, toner adhering to the toner image-receiving layer is fixed in fine detail without spreading into the image-receiving material, and the molten toner is cooled/solidified while adhering closely to the fixing belt. The toner is received while it is completely embedded in the toner image-receiving layer. Therefore, there are no image discrepancies, and a glossy, smooth toner image is obtained.

The, electrophotographic image-receiving material formed in the present invention is particularly suitable for a process for image formation using the oilless belt fixing method, and it permits a large improvement of offset. However, other imaging methods may also likewise be used.

For example, by using the electrophotographic image-receiving material, a full-color image can easily be formed while improving image quality and preventing cracks. A full-color image can be formed using an electrophotographic apparatus capable of forming full-color images. An ordinary electrophotographic apparatus comprises an image-receiving material transfer unit, a latent image-forming unit, and a developing unit which is disposed in the vicinity of the latent image-forming unit. Depending on the type, it may also comprise a latent image-forming unit in the center of the apparatus and a toner image intermediate transfer unit in the vicinity of the image-receiving material transfer unit.

To improve image quality, adhesion transfer or heat assistance transfer may be used instead of the electrostatic transfer or bias roller transfer, or in conjunction therewith. Specific details of these methods are given for example in JP-A Nos. 63-113576 and 05-341666. It is particularly preferred to use an intermediate transfer belt in the heat assistance transfer method. The intermediate belt may for example be an endless belt formed by electrocast nickel. Also, it is preferred to provide a cooling unit for the intermediate belt after toner transfer or in the latter half of transfer to the electrophotographic image-receiving material. Due to this cooling unit, the toner (toner image) is cooled to the softening temperature of the binder resin or below the glass transition temperature of the toner plus 10° C., hence the image is transferred to the electrophotographic image-receiving material efficiently and can be separated from the intermediate belt.

Fixing is an important step which influences the gloss and smoothness of the final image. The fixing method may be fixing by a heat and pressure roller, or belt fixing using a belt, but from the viewpoint of image quality such as gloss and smoothness, belt fixing is preferred. Belt fixing methods known in the art include for example an oilless type of belt fixing described in JP-A No. 11-352819, and the method in which second transfer and fixing are realized simultaneously described in JP-A Nos. 11-231671 and 05-341666. Further, a first fixing may also be performed by a heat roller before the pressurizing and heating by the fixing belt and fixing roller.

The surface of the fixing belt may receive a surface treatment of a silicone compound, fluorine compound or a combination thereof to prevent separation of the toner and prevent offset of toner components. Also, it is preferred to provide a belt cooling unit in the latter half of fixing step, which ameliorates the separation of the electrophotographic image-receiving material. The cooling temperature is preferably below the softening point, or below the glass transition temperature plus 10° C., of the toner binder resin and/or the polymer in the toner image-receiving layer of the electrophotographic image-receiving material. On the other hand, in the first stage of fixing, the temperature of the toner image-receiving layer or toner must be raised to the temperature at which they become sufficiently softened. Specifically, it is preferred, in practice, that the cooling temperature is 70° C. or less but 30° C. or more. It is preferred, in the initial stage of fixing, that 180° C. or less but 100° C. or more.

Herein, as the fixing belt, an endless belt formed from a material such as for example polyimide, electroplated nickel or aluminum, is suitable.

It is preferred to form a thin film comprising at least one material selected from a silicone rubber, a fluorinated rubber, a silicone resin or a fluorinated resin on the surface of the fixing belt. Of these, it is preferred to provide a layer of fluorocarbon siloxane rubber of uniform thickness on the surface of the fixing belt, or provide a layer of silicone rubber of uniform thickness on the surface of the fixing belt and then provide a layer of fluorocarbon siloxane rubber on the surface of the silicone rubber.

It is preferred that the fluorocarbon siloxane rubber has a perfluoroalkyl ether group and/or a perfluoroalkyl group in the main chain.

This fluorocarbon siloxane rubber comprises (A) a fluorocarbon polymer having a fluorocarbon siloxane of the following Formula (1) below as its main component, and containing aliphatic unsaturated groups, (B) an organopolysiloxane and/or fluorocarbon siloxane containing two or more ≡SiH groups in the molecule, and 1 to 4 times the molar amount of ≡SiH groups more than the amount of aliphatic unsaturated groups in the aforesaid fluorocarbon siloxane rubber, (C) a filler, and (D) a curing material comprising a fluorocarbon siloxane rubber composition containing an effective amount of catalyst.

The fluorocarbon polymer of component (A) comprises a fluorocarbon siloxane containing a repeating unit represented by the following Formula 1 as its main component, and contains aliphatic unsaturated groups.

Formula 1

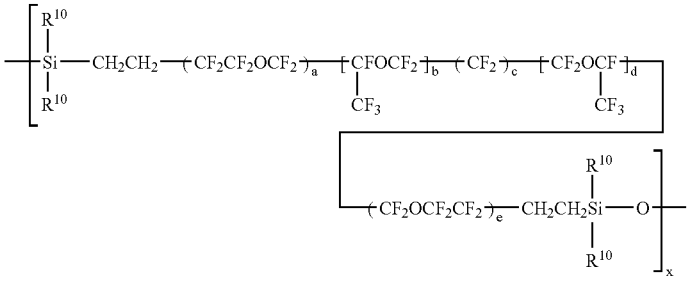

Herein, in the aforesaid Formula 1, "$R^{10}$" is a non-substituted or substituted monofunctional hydrocarbon group preferably containing 1 to 8 carbon atoms, preferably an alkyl group containing 1 to 8 carbon atoms or an alkenyl group containing 2 to 3 carbon atoms, and particularly preferably methyl. "a" and "e" are respectively 0 or 1, "b" and "d" are respectively integers in the range of 1 to 4, and "c" is an integer in the range 0 to 8. "x" is an integer equal to 1 or more, which is preferably 10 to 30.

An example of this component (A) is the substance shown by the following Formula 2:

Formula 2

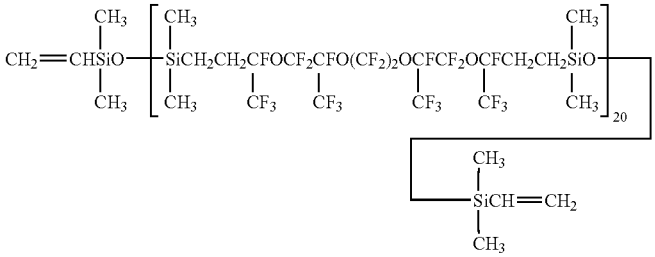

In Component (B), one example of the organopolysiloxane comprising ≡SiH groups is an organohydrogenpolysiloxane having at least two hydrogen atoms bonded to silicon atoms in the molecule.

In the fluorocarbon siloxane rubber composition used in the present invention, when the organocarbon polymer of Component (A) comprises an aliphatic unsaturated group, the aforesaid organohydrogenpolysiloxane may be used as a curing agent. Specifically, in this case, the cured product is formed by an addition reaction between aliphatic unsaturated groups in the fluorocarbon siloxane, and hydrogen atoms bonded to silicon atoms in the organohydrogenpolysiloxane.

Examples of these organohydrogenpolysiloxanes are the various organohydrogenpolysiloxanes used in addition curing silicone rubber compositions.

It is generally preferred that this organohydrogenpolysiloxane is blended in such a proportion that the number of δSiH groups therein is at least one, and particularly 1 to 5, relative to one aliphatic unsaturated hydrocarbon group in the fluorocarbon siloxane of Component (A).

It is preferred that in the fluorocarbon containing ≡SiH groups, one unit of Formula 1 or "$R^{10}$" in Formula 1 is dialkylhydrogensiloxane, the terminal group is a ≡SiH group such as dialkylhydrogensiloxane or silyl, and it can be represented by the following Formula 3.

Formula 3

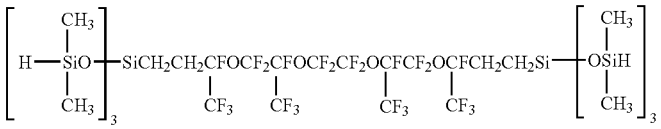

The filler which is Component (C) may be various fillers used in ordinary silicone rubber compositions. Examples are reinforcing fillers such as mist silica, precipitated silica, carbon powder, titanium dioxide, aluminum oxide, quartz powder, talc, sericite and bentonite, or fiber fillers such as asbestos, glass fiber and organic fibers or the like.

Examples of the catalyst which is Component (D) are chloroplatinic acid which is known in the art as an addition reaction catalyst, alcohol-modified chloroplatinic acid, complexes of chloroplatinic acid and olefins, platinum black or palladium supported on a support such as alumina, silica or carbon, and Group VIII elements of the Periodic Table or their compounds such as complexes of rhodium and olefins, chlorotris(triphenylphosphine) rhodium (Wilkinson catalyst) and rhodium (III) acetyl acetonate, and it is preferred to dissolve these complexes in an alcohol, ether or a hydrocarbon solvent.

Various blending agents may be added to the fluorocarbon siloxane rubber composition used in the present invention to the extent that they do not interfere with the purpose of the invention which is to improve solvent resistance. For example, dispersing agents such as diphenylsilane diol, low polymer chain end hydroxyl group-blocked dimethylpolysiloxane and hexamethyl disilazane, heat resistance improvers such as ferrous oxide, ferric oxide, cerium oxide and octyl acid iron, and colorants such as pigments or the like, may be added as necessary.

The fixing belt used is obtained by covering the surface of a heat resistant resin or metal belt with the aforesaid fluorocarbon siloxane rubber composition, and heat curing it, but the composition may be diluted to form a coating solution with a solvent such as m-xylene hexafluoride or benzotrifluoride which is then applied by an ordinary coating method such as spin coating, dip coating or knife coating. The heat curing temperature and time can be conveniently selected, but the selection is generally made, according to the belt type and manufacturing method, within the ranges of 100° C. to 500° C. and 5 seconds to 5 hours.

There is no particular limitation on the thickness of the fluorocarbon siloxane rubber layer forming the surface of the fixing belt, but to prevent separation of the toner and prevent offset of the toner component, and obtain an image with good fixing properties, it is 20 μm to 500 μm, and more preferably 40 μm to 200 μm.

The method of forming an image on the electrophotographic image-receiving material is not limited as long as it is a method using a fixing belt, and any ordinary method of electrophotography can be applied.

<Inkjet Recording Material>

The ink-jet recording material comprises, for example, a color material-receiving layer, on the recording material support of the present invention, which can accept a liquid ink such as a water-based ink (which uses a dye or pigment as colorant) oil-based ink, or a solid-state ink which is solid at ordinary temperature and melts to a liquid when printing the image. The ink-jet recording material may further comprise other layers, which is suitably selected according to the intended purpose, for example, a backing layer, a protective layer, an intermediate layer, an undercoat, a cushion layer, a charge control (inhibiting) layer, a reflecting layer, a tint adjusting layer, a storage ability improving layer, an anti-adhering layer, an anti-curl layer and a smoothing layer. These layers may be single layer structures or multilayer structures.

[Color Material-receiving Layer]

The color material-receiving layer contains at least polymer particles, and may also contain a water-soluble resin, a crosslinking agent, a mordant, and the like.

Polymer Particles

As the color material-receiving layer contains the polymer particles, a porous structure is obtained and the absorptivity of the ink therefore improves. If the solids of the polymer particle in the color material-receiving layer, is 50% by mass or more, and preferably 60% by mass or more, a superior porous structure can be formed, and it is therefore desirable from the viewpoint that an ink-jet recording material having sufficient ink absorptivity will be obtained. Herein the solids of the polymer particle in the color material-receiving layer is the content computed based on components other than the water in the composition forming the color material-receiving layer.

The polymer particles (latex) may be used in the form of a hydrophilic solvent dispersion of the polymers. Specifically, water dispersions of acrylic polymers, ester polymers, urethane polymers, amide polymers, olefin polymers, vinylidene chloride polymers, epoxy polymers, amide polymers, and modifications or copolymers thereof can be used. Of these, acrylic polymers, olefin polymers and urethane polymers are preferred, and from the viewpoint of ink absorptivity and film strength, olefin polymers and acrylic polymers are preferred.

As the olefin polymers, copolymers of vinylmonomers and diolefins are preferred. Examples of the vinylmonomers, which can be suitably used, are styrene, acrylonitrile, methacrylonitrile, methyl acrylate, methyl methacrylate, vinylacetate, and the like. Examples of the diolefins, which can be suitably used, are butadiene, isoprene, chloroprene, and the like.

In addition to these components, unsaturated carboxylic acids (e.g., crosslinkable components such as acrylic acid, methacrylic acid, itaconic acid, maleic anhydride, or alkyl esters thereof, acrolein, methacrolein, glycidyl acrylate, glycidyl methacrylate, 2-hydroxyethyl acrylate, 2-hydroxyethyl methacrylate, allyl acrylate, n-methylol acrylamide and vinylisocyanate) can also be added.

The acrylic polymer may for example be a homopolymer or copolymer of an acrylic acid or methacrylic acid ester having a straight-chain or branched aliphatic group having 1 to 18 carbon atoms, or an aliphatic group having a phenyl group, an aralkyl group or a hydroxyl group; acrylonitril; a N- or N,N-acrylamide of an alkyl group having 1 to 18 carbon atoms; acrylic acid, methacrylic acid or their salts; copolymers of these monomers with styrene sulfonic acid or vinylsulfonic acid and their salts, itaconic acid, maleic acid, fumaric acid and their salts; acid anhydrides such as anhydrous itaconic acid or maleic anhydride; vinylisocyanate, allyl isocyanate, vinylmethyl ether, vinylacetate, styrene or divinylbenzene.

These polymer particles are obtained by the emulsion polymerization method. Surfactants and polymerization initiators, which may be used therein, are those used in the usual method. The polymer particle synthesis is described in detail in U.S. Pat. No. 2,852,368, U.S. Pat. No. 2,853,457, U.S. Pat. No. 3,411,911, U.S. Pat. No. 3,411,912, U.S. Pat. No. 4,197,127, Belgian Patents No. 688,882, No. 691,360, No. 712,823, JP-B No. 45-5331, and JP-A Nos. 60-18540, 51-130217, 58-137831, 55-50240, and the like.

The average particle diameter of the polymer particles is preferably 10 nm to 100 nm, and more preferably 30 nm to 80 nm.

Water-soluble Resin

In the inkjet recording material, it is preferred that the color material-receiving layer contains a water-soluble resin together with the aforesaid polymer particles.

Examples of the water-soluble resin; are polyvinylalcohol resins having a hydroxyl group as a hydrophilic structural unit [for example, polyvinyl alcohol (PVA), acetoacetyl-modified polyvinylalcohol, cation-modified polyvinylalcohol, anion-modified polyvinylalcohol, silanol-modified polyvinylalcohol, polyvinyl acetal, and the like], cellulose resins [for example, methyl cellulose (MC), ethyl cellulose (EC), hydroxyethyl cellulose (HEC), carboxymethyl cellulose (CMC), hydroxypropyl cellulose (HPC), hydroxyethylmethyl cellulose, hydroxypropylmethyl cellulose, and the like], chitins, chitosans, starch, resins containing an ether bond [for example, polyethylene oxide (PEO), polypropylene oxide (PPO), polyethylene glycol (PEG), polyvinylether (PVE), and the like], and resins containing a carbamoyl group [for example, polyacryl amide (PAAM), polyvinyl pyrrolidone (PVP), polyacrylic-acid hydrazide, and the like].

Polyacrylates having a carboxyl group as a dissociative group, maleic resins, alginates and gelatin can also be mentioned.

Of these, the polyvinyl alcohol resin is preferred. Examples of this polyvinylalcohol are given in JP-B Nos. 04-52786, 05-67432, 07-29479, 2537827, 07-57553, 2502998, 3053231, JP-A No. 63-176173, JP-B No. 2604367, JP-A Nos. 07-276787, 09-207425, 11-58941, 2000-135858, 2001-205924, 2001-287444, 62-278080, 09-39373, JP-B No. 2750433, JP-A Nos. 2000-158801, 2001-213045, 2001-328345, 08-324105, 11-348417, and the like.

Examples of the water-soluble resins other than polyvinylalcohol resins are the compounds mentioned in [0011] to [0014] of JP-A No. 11-165461.

These water-soluble resins may be used alone, or in combination of two or more.

The content of the water-soluble resin is preferably 9% by mass to 40% by mass, more preferably 12% by mass to 33% by mass, relative to the total solids in the color material-receiving layer.

In ink-jet recording, the porous color material-receiving layer obtained as mentioned above can quickly absorb ink by capillarity, and form truly circular dots without any ink blotting.

Mass Content Ratio of Polymer Particles and Water-soluble Resin

The mass content ratio [PB ratio (x: y)] of polymer particles (x) and the water-soluble resin (y) has a large effect also on the film structure and film strength of the color material-receiving layer. That is, if the mass content ratio [PB ratio] increases, voids, pore volume and surface area (per unit mass) will increase, but density and strength tend to fall.

In the color material-receiving layer, if the mass content ratio [PB ratio (x: y)] is too large, the film strength decreases and cracks are formed during drying, whereas if this PB ratio is too small, the voids tend to be sealed by the resin so ink absorptivity falls, therefore to avoid these problems, the PB ratio is preferably 5/1 to 20/1, and more preferably 10/1 to 20/1.

When the recording material passes through the transfer system of an inkjet printer, stresses act on the recording material, so the color material-receiving layer must have sufficient film strength. Also, it is preferred that the color material-receiving layer has sufficient hardness so that when it is cut into a sheet, cracking or peeling of the color material-receiving layer do not occur.

Crosslinking Agent

In the color material-receiving layer of the inkjet recording material, the coating layer containing the water-soluble resin, preferably further contains a crosslinking agent which can crosslink the water-soluble resin, and it preferably has the aspect of a porous layer using both the polymer particles and the water-soluble resin cured by a crosslinking reaction of this crosslinking agent with the water-soluble resin.

For crosslinking the water-soluble resin and in particular polyvinylalcohols, boron compounds are preferred. Examples of this boron compound are borax, boric acid, borates (e.g., orthoborates), $InBO_3$, $ScBO_3$, $YBO_3$, $LaBO_3$, $Mg_3(BO_3)_2$, $Co_3(BO_3)_2$, diborates (e.g., $Mg_2B_2O_5$, $Co_2B_2O_5$), metaborates, (e.g., $LiBO_2$, $Ca(BO_2)_2$, $NaBO_2$, $KBO_2$), tetraborates (e.g., $Na_2B_4O_7.10H_2O$) and pentaborates (e.g., $KB_5O_8.4H_2O$, $Ca_2B_6O_{11}.7H_2O$, $CsB_5O_5$). Of these, borax, boric acid and borates are preferred, and boric acid is particularly preferred, as the crosslinking reaction occurs rapidly.

As the crosslinking agents for the water-soluble resins, non-boron compounds can also be used.

Aldehyde compounds, such as formaldehyde, glyoxal, glutaraldehyde and the like; ketone compounds, such as deacetyl, cyclo 2,4-pentanedione, and the like; active halogen compounds such as bis(2-chloroethyl urea)-2-hydroxy-4,6-dichloro-1,3,5-triazine, 2,4-dichloro-6-S-triazine sodium salt, and the like; active vinylcompounds such as divinylsulfonic acid, 1,3-vinylsulfonyl-2-propanol, N,N'-ethylene bis(vinylsulfonyl acetamide), 1,3,5-triacryloyl-hexahydro-S-triazine, and the like; n-methylol compounds such as dimethylol urea, methylol dimethylhydantoin, and the like; melamine resins such as methylol melamine, alkylated methylol melamine, and the like; epoxy resins; isocyanate compounds, such as 1,6-hexamethylene diisocyanate, and the like; azidine compounds disclosed in U.S. Pat. Nos. 3,017,280, 2,983,611, and the like; carboxyimide compounds disclosed in U.S. Pat. No. 3,100,704, and the like; epoxy compounds such as glycerol triglycidyl ether, and the like; ethylene imino compounds such as 1,6-hexamethylene-N,N'-bis ethylene urea, and the like; halogenated carboxy aldehyde compounds, such as mucochloric acid, mucophenoxychloric acid, and the like; dioxane compounds such as 2,3-dihydroxydioxane, and the like; metal-containing compounds such titanium lactate, aluminum sulfate, chromium alum, potash alum, zirconium acetate, chromium acetate, and the like; polyamine compounds such as tetraethylenepentamine, and the like; hydrazide compounds such as hydrazide adipate, and the like; and low molecular weight compounds or polymers containing two or more oxazoline groups, and the like.

The above-mentioned crosslinking agents may be used alone, or in combination of two or more.

The crosslinking/curing is performed by adding the crosslinking agent to the coating solution containing polymer particles or a water-soluble resin (hereafter, may be referred to as "coating solution A") and/or the following basic solution.

A basic solution of pH8 or higher (hereafter, may be referred to as "coating solution B") is preferably added to a coating layer (1) at the same time as the coating layer is formed by applying the coating solution A or (2) during drying of the coating layer formed by applying the coating solution and before the coating layer shows decreased drying.

The crosslinking agent is preferably added in the following manner, taking a boron compound as an example. Specifically, when the color material-receiving layer is a layer formed by crosslinking/curing a coating layer obtained by applying the coating solution (coating solution A) comprising a water-soluble resin containing polymer fine particles and polyvinylalcohol, the basic solution of pH 8 or higher (coating solution B) is added to the aforesaid coating layer (1) at the same time as the coating layer is formed by applying the coating solution, or (2) during drying of the coating layer formed by applying the coating solution and before the coating layer shows decreased drying. The boron compound as a crosslinking agent may be contained in one of the coating solution A and coating solution B, or may be contained in both the coating solution A and coating solution B.

The amount of the crosslinking agent used is preferably 1% by mass to 50% by mass, and more preferably 5% by mass to 40% by mass, relative to the water-soluble resin.

Mordant

In the present invention, to improve the water resistance of the image formed, the color material-receiving layer preferably contains a mordant.

The mordant is preferably an organic mordant which is a cationic polymer (cationic mordant), or an inorganic mordant. By including the mordant in the color material-receiving layer, it interacts with a liquid ink containing an anionic dye as color material, so the color material is stabilized, water resistance is improved, and blurring over time is improved. An organic mordant and an inorganic mordant may be used separately, or an organic mordant and inorganic mordant may be used together.

The mordant may be added to the coating solution A containing polymer fine particles and the water-soluble resin or when there is concern that aggregation with polymer particles might occur, it may be contained in coating solution B and applied.

The aforesaid cationic mordant may be a polymer mordant adding a primary-tertiary amine, or quaternary ammonium salt, as the cationic group, but a cationic non-polymer mordant may also be used. From the viewpoint of ink absorptivity improvement of the color material-receiving layer, the mordant is preferably a compound having a mass average molecular weight of 500 to 100,000.

The aforesaid polymer mordant is preferably obtained as the homopolymer of a monomer (mordanting monomer) comprising a primary-tertiary amine or quaternary ammonium salt, or as a copolymer or condensation polymer of this mordanting monomer and another monomer (hereafter, referred to as "non mordanting monomer"). These polymer mordants can be used as water-soluble polymer or water-dispersible latex particles.

Examples of this monomer (mordanting monomer) are trimethyl-p-vinylbenzyl ammonium chloride, trimethyl-m-vinylbenzyl ammonium chloride, triethyl-p-vinylbenzyl ammonium chloride, triethyl-m-vinylbenzyl ammonium chloride, N,N-dimethyl-N-ethyl-N-p-vinylbenzyl ammonium chloride, N,N-diethyl-N-methyl-N-p-vinylbenzyl ammonium chloride, N,N-dimethyl-N-n propyl-N-p-vinylbenzyl ammonium chloride, N,N-dimethyl-N-n octyl-N-p-vinylbenzyl ammonium chloride, N,N-dimethyl-N-benzyl-N-p-vinylbenzyl ammonium chloride, N,N-diethyl-N-benzyl-N-p-vinylbenzyl ammonium chloride, N,N-dimethyl-N-(4-methyl)benzyl-N-p-vinylbenzyl ammonium chloride, N,N-dimethyl-N-phenyl-N-p-vinylbenzyl ammonium chloride; trimethyl-p-vinylbenzyl ammonium bromide, trimethyl-m-vinylbenzyl ammonium bromide, trimethyl-p-vinylbenzyl ammonium sulfonate, trimethyl-m-vinylbenzyl ammonium sulfonate, trimethyl-p-vinylbenzyl ammonium acetate, trimethyl-m-vinylbenzyl ammonium acetate, N,N,N-triethyl-N-2-(4-vinylphenyl)ethyl ammonium chloride, N,N,N-triethyl-N-2-(3-vinylphenyl)ethyl ammonium chloride, N,N-diethyl-N-methyl-N-2-(4-vinylphenyl)ethyl ammonium chloride, N,N-diethyl-N-methyl-N-2-(4-vinylphenyl)ethyl ammonium acetate; N,N-dimethylamino ethyl(meth)acrylate, N,N-diethylaminoethyl (meth)acrylate, N,N-dimethyl aminopropyl (meth)acrylate, N,N-diethylaminopropyl(meth)acrylate, N,N-dimethylaminoethyl(meth)acrylamide, N,N-diethylaminoethyl (meth) acrylamide, N,N-dimethylaminopropyl(meth)acrylamide, methyl chloride, ethyl chloride, methyl bromide, ethyl bromide, methyl iodide or ethyl iodide quaternary compound of N,N-diethylaminopropyl(meth)acrylamide, and sulfonates, alkyl sulfonates, acetates or alkyl carboxylates which replace these anions.

Specific examples thereof are monomethyl diallyl ammonium chloride, trimethyl-2-(methacryloyloxy-)ethyl ammonium chloride, triethyl-2-(methacryloyloxy-)ethyl ammonium chloride, trimethyl-2-(acryloyloxy-)ethyl ammonium chloride, triethyl-2-(acryloyloxy-)ethyl ammonium chloride, trimethyl-3-(methacryloyloxy-)propyl ammonium chloride, triethyl-3-(methacryloyloxy-)propyl ammonium chloride, trimethyl-2-(methacryloylamino)ethyl ammonium chloride, triethyl-2-(methacryloylamino)ethyl ammonium chloride, trimethyl-2-(acryloylamino)ethyl ammonium chloride, triethyl-2-(acryloylamino)ethyl ammonium chloride, trimethyl-3-(methacryloylamino)propyl ammonium chloride, triethyl-3-(methacryloylamino)propyl ammonium chloride, trimethyl-3-(acryloylamino)propyl ammonium chloride, triethyl-3-(acryloylamino)propyl ammonium chloride; N,N-dimethyl-N-ethyl-2-(methacryloyloxy-)ethyl ammonium chloride, N,N-diethyl-N-methyl-2-(methacryloyloxy-)ethyl ammonium chloride, N,N-dimethyl-N-ethyl-3-(acryloylamino)propyl ammonium chloride, trimethyl-2-(methacryloyloxy-)ethyl ammonium bromide, trimethyl-3-(acryloylamino)propyl ammonium bromide, trimethyl-2-(methacryloyloxy-)ethyl ammonium sulfonate, trimethyl-3-(acryloylamino)propyl ammonium acetate, and the like.

In addition, copolymerizable monomers such as N-vinylimidazole and N-vinyl-2-methylimidazole can be mentiond.

Allylamines and diallylamines or their derivatives and salts can also be used. Examples of such compounds are allylamine, allylamine hydrochloride, allylamine acetate, allylamine sulfate, diallylamine, diallylamine hydrochloride, diallylamine acetate, diallylamine sulfate, diallylmethylamine and its salts (e.g., hydrochlorides, acetates, sulfates), diallylethylamine and its salts (e.g., hydrochlorides, acetates, sulfates), and diallyldimethylammonium salts (the opposite anion being chloride, acetate ion, sulfate ion, etc.). It is common to polymerize in the form of a salt, since such allylamines and diallylamine derivatives have poor polymerization properties in the form of the amine, and then to desalt, if necessary.

Using N-vinylacetamide and N-vinylformamide, a vinylamine unit and salts made therefrom by hydrolysis after polymerization, may also be used.

The non-mordanting monomer is a monomer not containing a basic or cationic part such as primary-tertiary amines and their salts or quaternary ammonium salts, and not interacting with the dye in inkjet ink or showing an effectively small interaction.

Examples of the non-mordanting monomer are (meth) acrylic acid alkyl esters; (meth)acrylic acid cycloalkyl esters, such as cyclohexyl (meth)acrylate, and the like; acrylic acid aryl esters, such as phenyl (meth)acrylate, and the like; aralkyl esters, such as benzyl (meth)acrylate, and the like; aromatic vinyl compounds such as styrene, vinyltoluene, α-methyl styrene, and the like; vinylesters, such as vinylacetate, vinyl propionate, vinyl basagate, and the like; allyl esters, such as allyl acetate, and the like; halogen-containing monomers, such as vinylidene chloride, vinyl chloride, and the like; vinylcyanides, such as (meth)acrylonitrile, and the like; and olefins such as ethylene, propylene, and the like.

The (meth)acrylic acid alkyl ester is preferably an alkyl ester of (meth)acrylic acid having 1 to 18 carbon atoms in the alkyl part, for example, methyl (meth)acrylate, ethyl (meth)acrylate, propyl (meth)acrylate, isopropyl (meth) acrylate, n-butyl (meth)acrylate, isobutyl (meth)acrylate, t-butyl (meth)acrylate, hexyl (meth)acrylate, octyl (meth) acrylate, 2-ethylhexyl (meth)acrylate, lauryl (meth)acrylate, stearyl (meth)acrylate or the like.

Of these, methyl acrylate, ethyl acrylate, methyl methacrylate, ethyl methacrylate and hydroxyethyl methacrylate are preferred.

The non-mordanting monomer may be used alone, or in combination of two or more.

Examples of the polymer mordants, which are suitable, are polydiallyldimethyl ammonium chloride, polymethacryloyloxy-ethyl-beta-hydroxyethyldimethyl ammonium chloride, polyethylene imine, polyallylamine and its derivatives, polyamide-polyamine resins, cationic starch, dicyandiamide formalin condensate, dimethyl-2-hydroxypropyl ammonium salt polymers, polyamidine, polyvinyl amine, dicyan cationic resins represented by dicyandiamide-formalin condensation polymer, polyamine cationic resins represented by dicyanamide-diethylenetriamine condensation polymer, epichlorhydrin dimethylamine addition polymer, dimethyldiallyn ammonium chloride-$SO_2$ copolymer, diallylamine salt-$SO_2$ copolymer, (meth)acrylate-containing polymers having a quaternary ammonium-salt substituted alkyl group in the ester part, stearyl polymers having a quaternary ammonium-salt substituted alkyl group, and the like.

Examples of the polymer mordant are given for example in JP-A Nos. 48-28325, 54-74430, 54-124726, 55-22766, 55-142339, 60-23850, 60-23851, 60-23852, 60-23853, 60-57836, 60-60643, 60-118834, 60-122940, 60-122941, 60-122942, 60-235134 and 01-161236; U.S. Pat. Nos. 2,484,430, 2,548,564, 3,148,061, 3,309,690, 4,115,124, 4,124,386, 4,193,800, 4,273,853, 4,282,305 and 4,450,224; JP-A Nos. 01-161236, 10-81064, 10-119423, 10-157277, 10-217601, 11-348409, 2001-138621, 2000-43401, 2000-211235, 2000-309157, 2001-96897, 2001-138627, 11-91242, 08-2087, 08-2090, 08-2091, 08-2093, 08-174992, 11-192777, 2001-301314; JP-B Nos. 05-35162, 05-35163, 05-35164 and 05-88846; JP-A Nos. 7-118333, 2000-344990; JP-B Nos. 2648847, 2661677. Of these, polyallylamine and its derivatives are preferred.

From the viewpoint of preventing blotting with time, the aforesaid organic mordant is preferably a polyallylamine or derivative thereof having a mass average molecular weight of 100,000 or less.

The polyallylamine and its derivatives may be an allylamine polymer and its derivatives. Examples of such derivatives are salts of polyallylamines and acids (inorganic acids such as hydrochloric acid, sulfuric acid, phosphoric acid, nitric acid, organic acids such as methansulfonic acid, toluenesulfonic acid, acetic acid, propionic acid, cinnamic acid, (meth)acrylic acid, or combinations thereof, or partial salts of allylamines), derivatives obtained by a polymerization reaction of polyallylamines, and copolymers of polyallylamines and other copolymerizable monomers (examples of this monomer are (meth)acrylic esters, styrenes, (meth) acrylamides, acrylonitrile and vinyl esters).

Examples of the polyallylamine and its derivatives are given in JP-B Nos. 62-31722, 02-14364, 63-43402, 63-43403, 63-45721, 63-29881, 01-26362, 02-56365, 02-57084, 0441686, 06-2780, 06-45649, 06-15592, 04-68622; JP-B Nos. 3199227, 3008369; JP-A Nos. 10-330427, 11-21321, 2000-281728, 2001-106736, 62-256801, 07-173286, 07-213897, 09-235318, 09-302026, 11-21321; WO99/21901, WO99/19372; JP-A No. 05-140213, JP-A No. 11-506488, and the like.

The mordant may also be an inorganic mordant, such as a polyvalent water-soluble metal salt and hydrophobic metal salt compound.

Examples of the inorganic mordants are metal salts or complexes of metals selected from magnesium, aluminium, calcium, scandium, titanium, vanadium, manganese, iron, nickel, copper, zinc, gallium, germanium, strontium, yttrium, zirconium, molybdenum, indium, barium, lanthanum, cerium, praseodymium, neodimium, samarium, europium, gadolinium, dysprosium, erbium, ytterbium, hafnium, tungsten and bismuth.

Specific examples thereof are calcium acetate, calcium chloride, calcium formate, calcium sulfate, barium acetate, barium sulfate, barium phosphorate, manganese chloride, manganese acetate, manganese formate dihydrate, manganese ammonium sulfate hexahydrate, cupric chloride, ammonium copper (II) chloride dihydrate, copper sulfate, cobalt chloride, cobalt thiocyanate, cobalt sulfate, nickel sulfate hexahydrate, nickel chloride hexahydrate, nickel acetate tetrahydrate, nickel ammonium sulfate hexahydrate, nickel amidosulfate tetrahydrate, aluminium sulfate, aluminium alum, basic polyaluminium hydroxide, aluminium sulfite, aluminium thiosulfate, polyaluminium chloride, aluminium nitrate nonahydrate, aluminium chloride hexahydrate, ferrous bromide, ferrous chloride, ferric chloride, ferrous sulfate, ferric sulfate, zinc phenolsulfonate, zinc bromide, zinc chloride, zinc nitrate hexahydrate, zinc sulfate, titanium tetrachloride, tetraisopropyl titanate, titanium acetyl acetonate, titanium lactate, zirconium acetyl acetonate, zirconium acetate, zirconium sulfate, zirconium ammonium carbonate, zirconyl stearate, zirconyl octate, zirconyl nitrate, zirconium oxychloride, zirconium hydroxychloride, chromium acetate, chromium sulfate, magnesium sulfate, magnesium chloride hexahydrate, magnesium citrate nonahydrate, sodium phosphotungstate, sodium tungsten citrate, 12-tungstophosphoric acid n-hydrate, 12-tungstosilic acid 26-hydrate, molybdenum chloride, 12-molybdophosphoric acid n-hydrate, gallium nitrate, germanium nitrate, strontium nitrate, yttrium acetate, yttrium chloride, yttrium nitrate, indium nitrate, lanthanum nitrate, lanthanum chloride, lanthanum acetate, lanthanum benzoate, cerium chloride, cerium sulfate, cerium octate, praseodymium nitrate, neodymium nitrate, samarium nitrate, europium nitrate, gadolinium nitrate, dysprosium nitrate, erbium nitrate, ytterbium nitrate, hafnium chloride, bismuth nitrate, and the like.

The inorganic mordant is preferably an aluminium-containing compound, titanium-containing compound, zirconium-containing compound, or a metal compound (salt or complex) of the Group IIIB series of the Periodic Table of Elements.

The content of mordant in the color material-receiving layer is preferably 0.01 $g/m^2$ to 5 $g/m^2$, and more preferably 0.1 $g/m^2$ to 3 $g/m^2$.

Other Components

To the inkjet recording material, various additives known in the art, for example, acid, an ultraviolet light absorber, an antioxidant, a florescent whitening agent, a monomer, a polymerization initiator, a polymerization inhibitor, a blot inhibitor, a preservatitves, a viscosity stabilizer, a deforming agent, a surfactant, a antistatic agent, a matting agent, a curl inhibitor or a water-resisting agent, can be further added, if necessary.

<Silver Photographic Photosensitive Material>

The silver photographic photosensitive material, for example, comprises image-forming layers, which produce at least the colors of YMC (yellow, magenta and cyan), on the recording material support of the present invention, and is used as a silver halide photographic sheet in silver halide photography, in which the exposed silver halide photographic sheet is impregnated in and passed through plural treatment tanks so that color developing, bleach fixing, water rinsing and drying are carried out, and the like.

<Heat Transfer Image-receiving Material>

The heat transfer image-receiving material, for example, comprises at least a thermofusion ink layer as an image-forming layer on the recording material support of the present invention, in which the thermofusion ink layer is heated by a thermosensitive head, so that ink is transferred on the surface of the heat transfer image-receiving material from thermofusion ink layer.

<Thermosensitive Color Recording Material>

The thermosensitive color recording material, for example, comprises at least a thermosensitive coloring layer on the recording material support of the present invention, and in used in the thermoautochrome method (TA method) which form an image by repeatedly heating using a thermosensitive head, and fixing by ultraviolet light, and the like.

<Sublimation Transfer Image-receiving Material>

The sublimation transfer image-receiving material, for example, comprises at least an ink layer including thermodiffusing pigment (sublimating pigment) on the recording material support of the present invention, and in used in a sublimation transfer method in which the thermodiffusing pigment is transferred from the ink layer to the surface of the sublimation transfer recording image-receiving material by heating with a thermosensitive head.

EXAMPLES

The present invention will now be described referring to specific examples, but it should be understood that the invention is not be construed as being limited in any way thereby.

In the following Examples and Comparative Examples, "%" and "parts" are based on mass.

Example 1

Preparation of Support

A broad-leaf kraft pulp (LBKP) was beaten to 300 ml (Canadian standard freeness, C.F.S.) by a disk refiner, and adjusted to an average mass fiber length of 0.58 mm. Various additives were added to this pulp in the following proportions based on the mass of pulp.

| Additive type | content (%) |
|---|---|
| Cationic starch | 1.2 |
| Alkyl ketene dimer (AKD) | 0.4 |
| Anion polyacrylamide | 0.2 |

-continued

| Additive type | content (%) |
|---|---|
| Epoxy fatty acid amide (EFA) | 0.2 |
| Polyamide-polyamine-epichlorhydrin | 0.3 |

Notes)
AKD denotes an alkyl ketene dimer (the alkyl part is derived from a fatty acid based mainly on behenic acid), EFA denotes an epoxy fatty acid amide (the fatty acid part is derived from a fatty acid based on behenic acid).

The pulp obtained was used to prepare raw paper, which has basis weight of 150 g/m$^2$, utilizing a Fourdrinier paper machine. A polyethylene soap-free emulsion was coated on the surface of raw paper between the drying zones of the Fourdrinier paper machine (surface coated with the toner image-receiving layer) at a coverage of 3 g/m$^2$ in solids.

At the end of the step of the paper-making, the density was adjusted to 1.01 g/cm$^3$ by calender treatment such that metal rollers came in contact with the surface where the toner image-receiving layer was provided, and the support of Example 1 was thereby obtained. The surface temperature of the metal rollers was 140° C.

Examples 2 to 5 and Comparative Examples 1 to 3

As shown in Table 1, the supports of Examples 2 to 5 and Comparative Examples 1 to 3 were manufactured as in Example 1, except that the surface-treating agent used for the raw paper, and the temperature conditions of calender treatment, were changed.

For the supports obtained in Examples 1 to 5 and Comparative Examples 1 to 3, the Cobb size, Bekk smoothness and surface smoothness were measured by the following methods. The results are shown in Table 1.

<Cobb Size>

Measured according to JIS P8140.

<Bekk Smoothness>

Measured according to JIS P 8119.

<Surface Smoothness>

The central square average roughness (SRa) of the surface of the support, where the toner image-receiving layer was provided, was measured at a cutoff of 5 mm to 6 mm based on the following measurement and analysis conditions, using a surface shape measuring apparatus, Surfcom 570A-3DF (Tokyo Seimitsu Co., Ltd.).

| Measurement and analysis conditions | |
|---|---|
| Scanning direction: | MD direction of sample |
| Measurement length: | Papermaking (X) direction 50 mm, perpendicular (Y) direction 30 mm |
| Measurement pitch: | X direction 0.1 mm, Y direction 0.1 mm |
| Scanning speed: | 30 mm/sec |
| Bandpass filter: | 5 mm to 6 mm |

The variation [ΔSRa;(SRa before contacting water)−(SRa after contacting water)] of SRa before and after the surface of the support, where the toner image-receiving layer was provided, was brought in contact with water at 20° C. for 2 minutes, was measured.

TABLE 1

| | | Example | | | | | Comp. Ex. | | |
|---|---|---|---|---|---|---|---|---|---|
| | | 1 | 2 | 3 | 4 | 5 | 1 | 2 | 3 |
| Surfactant | Polyethylene soap-free emulsion ($g/m^2$) | 3.0 | 0.5 | — | — | — | — | — | — |
| | Polyethylene soap-free emulsion ($g/m^2$) | — | — | 3.5 | 1.0 | — | — | — | — |
| | Petroleum resin/wax emulsion ($g/m^2$) | — | — | — | — | 1.0 | — | — | — |
| | Carboxyl-modified PVA ($g/m^2$) | — | — | — | — | — | 1.5 | — | — |
| | Oxidized starch ($g/m^2$) | — | — | — | — | — | — | 3.0 | — |
| | Polyacrylamide ($g/m^2$) | — | — | — | — | — | — | — | 1.0 |
| Calender treatment temperature (° C.) | | 140 | 150 | 140 | 150 | 120 | 120 | 90 | 100 |
| Density ($g/cm^3$) | | 1.01 | 1.05 | 1.03 | 0.97 | 0.91 | 1.01 | 0.85 | 0.91 |
| Cobb size ($g/m^2$) | | 4.1 | 8.9 | 3.4 | 7.2 | 8.2 | 18.9 | 20.1 | 19.1 |
| Bekk smoothness (seconds) | | 207 | 189 | 223 | 178 | 151 | 195 | 110 | 0.92 |
| Central square average roughness (μm) | | 0.53 | 0.45 | 0.51 | 0.56 | 0.62 | 0.55 | 0.81 | 0.73 |
| ΔSRa (μm) | | 0.02 | 0.04 | 0.01 | 0.06 | 0.04 | 0.2 | 0.14 | 0.13 |

* Polyethyle soap-free emulsion (melting point = 104° C., Unitika Ltd.)
* Petroleum resin/wax emulsion (melting point = 65° C., Japan PMC)
* Carboxy-modified PVA (Kuraray)
* Oxidized starch (Nihon Shokuhin Kako)
* Polyacrylamide (Arakawa Chemical Industries)

Examples 6 to 10 and Comparative Examples 4 to 6

Manufacture of Electrophotographic Image-receiving Sheet

The electrophotographic image-receiving sheet (electrophotographic image-receiving material) was manufactured as follows using the supports obtained.

A toner image-receiving layer coating solution and backing layer coating solution of the following compositions were applied, by a bar coater, to the surface of the support (where the toner image-receiving layer is provided) in contact with the heating rollers.

Preparation of Toner Image-receiving Layer Coating Solution (Titanium Dioxide Dispersion Solution)

The following components were blended and dispersed using a Nippon Seiki NBK-2 to prepare a titanium dioxide dispersion solution (titanium dioxide pigment 40% by mass).

| | |
|---|---|
| Titanium dioxide (Tipec (registered trademark) A-220, Ishihara Sangyo Kaisha, Ltd.) | 40.0 g |
| PVA102 | 2.0 g |
| Ion exchange water | 58.0 g |

Toner Image-receiving Layer Coating Solution

The following components were mixed and stirred to prepare a toner image-receiving layer coating solution.

| | |
|---|---|
| Aforesaid titanium dioxide dispersion solution | 15.5 g |
| Carnauba wax dispersion solution (Cellosol 524, Chukyo Oils and Fats) | 15.0 g |
| Polyester resin water dispersion (solids 30% by mass, KZA-7049, Unitika Ltd.) | 100.0 g |
| Thickener (Alcox E30, Meisei Chemicals) | 2.0 g |
| Anionic surfactants (AOT) | 0.5 g |
| Ion exchange water | 80 ml |

The viscosity of the toner image-receiving layer coating solution was 40 mPa·s, and its surface tension was 34 mN/m.

Preparation of Backing Layer Coating Solution

The following components were mixed and stirred to prepare a backing layer coating solution.

| | |
|---|---|
| Acrylate resin water dispersion (solids 30% by mass, High-loss XBH-997L, Seiko Chemicals) | 100.0 g |
| Matting agent (Tecpoma-MBX-12, Sekisui Chemical Industries) | 5.0 g |
| Releasing agent (Hydrine D337, Chukyo Oils and Fats) | 10.0 g |
| Thickener (CMC) | 2.0 g |
| Anionic surfactant (AOT) | 0.5 g |
| Ion exchange water | 80 ml |

The viscosity of the backing layer coating solution was 35 mPa·s; and its surface tension was 33 mN/m.

<Coating of Backing Layer and Toner Image-receiving Layer>

The aforesaid backing layer coating solution was applied to the back surface of the support by a bar coater, and the toner image-receiving layer coating solution was applied to the other surface of the support by a bar coater in the same way as the backing layer.

The toner image-receiving layer coating solution and backing layer coating solution were applied so that, for the backing layer, the coating amount was 9 $g/m^2$ in terms of dry mass, and for the toner image-receiving layer, the coating amount was 12 g in terms of dry mass.

After the backing layer and toner image-receiving layer were applied, they were dried by hot air online. The dry air amount and temperature were adjusted so that drying takes place within 2 minutes after coating for both the back surface and toner image-receiving surface. The drying temperature was set so that the coating surface temperature is identical to the wet bulb temperature of the dry air.

After drying, calender treatment was performed. The calender treatment was performed by a gloss calender with the metal rollers kept warm at 40° C., at a pressure of 147 N/cm (15 kgf/cm).

<Evaluation>

The electrophotographic image-receiving sheet was cut to A4 size, and an image was formed by the following method. The printer was a Fuji Xerox color laser printer (DocuColor 1250-PF) modified with the fixing belt system shown in FIGURE.

In the fixing belt system shown in FIGURE, a fixing belt 2 is suspended across a heating roller 3 and tension roller 5. A cleaning roller 6 is provided above the tension roller 5, putting the fixing belt 2 between, and a pressure roller 4 is provided below the heating roller 3, putting the fixing belt 2 between. The electrophotographic image-receiving sheet comprising the toner image is inserted between the heating roller 3 and pressure roller 4 from the right-hand side in FIGURE, fixed, and then carried on the fixing belt 2 to be cleaned by the cleaning roller 6.

In the fixing belt system, the transport speed of the fixing belt 2 is 30 mm/sec, the pressure between the heating roller 3 and pressure roller 4 is 0.2 MPa (2 kgf/cm$^2$), and the set temperature of the heating roller 3 is 130° C., which corresponds to the fixing belt temperature. The set temperature of the pressure roller 4 is 120° C.

The fixing belt is obtained by coating DY39–115 which is a silicone rubber primer manufactured by Toray Dow Corning, onto a polyimide base layer, drying in air for 30 minutes, forming a film by impregnation coating of a coating solution prepared from 100 parts by mass of DY35–796AB which is a silicone rubber precursor and 30 parts by mass of n-hexane, and performing a primary vulcanization at 120° C. for 10 minutes to obtain a silicone rubber layer of 40 μm.

A coating solution prepared from 100 parts by mass of SIFEL 610 which is a fluorocarbon siloxane rubber precursor manufactured by Shin-Etsu Chemical Industries and 20 parts by mass of a fluorine solvent (mixed solution of m-xylene hexafluoride, perfluoroalkane and perfluoro(2-butyltetrahydrofuran), was then formed by impregnation coating on this silicone rubber layer, performing a primary vulcanization at 120° C. for 10 minutes and performing a secondary vulcanization at 180° C. for 4 hours to obtain a fixing belt of fluorocarbon siloxane rubber having a film thickness of 20 μm.

Image Quality

The electrophotographic image-receiving sheets were evaluated by forming a portrait of woman by the above-mentioned process for image formation, according to the following criteria. The results are shown in Table 2.

[Evaluation Criteria]

A: Best

B: Good, can be used (within tolerance).

C: Poor, cannot be used (cannot be used in practice).

D: Very poor, cannot be used.

Glossiness

The glossiness of the electrophotographic image-receiving sheets (electrophotography print) was estimated visually, and evaluated on the following basis. The results are shown in Table 2.

[Evaluation Criteria]

A: Best

B: Good, can be used (within tolerance).

C: Poor, cannot be used (cannot be used in practice).

D: Very poor, cannot be used.

TABLE 2

| | Support | Image quality | Glossiness |
|---|---|---|---|
| Example 6 | Example 1 | A | A |
| Example 7 | Example 2 | A | B |
| Example 8 | Example 3 | A | A |
| Example 9 | Example 4 | B | A |
| Example 10 | Example 5 | B | B |
| Comp. Ex. 4 | Comp. Ex. 1 | C | C |
| Comp. Ex. 5 | Comp. Ex. 2 | D | D |
| Comp. Ex. 6 | Comp. Ex. 3 | C | D |

From the results of Table 2, it is seen that the electrophotographic image-receiving sheets of Examples 6 to 10 using the support of Examples 1 to 5 give far superior image quality and gloss, and image clarity, than those of Comparative Examples 4 to 6.

Example 11

Preparation of Raw Paper

A broad-leaf kraft pulp (LBKP) was beaten to 300 ml (Canadian standard freeness, C.F.S.) by a disk refiner, and adjusted to an average mass fiber length of 0.58 mm. Various additives were added to this pulp in the following proportions based on the mass of pulp.

| Additive type | content (%) |
|---|---|
| Cationic starch | 1.2 |
| Alkyl ketene dimer (AKD) | 0.5 |
| Anion polyacrylamide | 0.3 |
| Epoxy fatty acid amide (EFA) | 0.2 |
| Polyamide polyamine epichlorhydrin | 0.3 |

Notes)
AKD denotes an alkyl ketene dimer (the alkyl part is derived from a fatty acid based mainly on behenic acid), EFA denotes an epoxy fatty acid amide (the fatty acid part is derived from a fatty acid based on behenic acid).

Raw paper having basis weight of 150 g/m$^2$ was manufactured from the pulp obtained using a Fourdrinier paper machine. 1.0 g/cm$^2$ PVA and 0.8 g/cm$^2$ $CaCl_2$ was manufactured by a size-press apparatus in the dry zone of the Fourdriner paper machine.

In the final state of the paper-making process, the density was adjusted to 1.01 g/cm$^3$ using a soft calender. The raw paper obtained was passed through so that the metal rollers came in contact with the side (surface) provided with the toner image-receiving layer. The surface temperature of the metal rollers was 140° C. The Oken type smoothness of the raw paper obtained in Example 11 was 265 seconds, and the Stökigt sizing degree was 127 seconds.

Preparation of Toner Image-receiving Layer Coating Solution

The following components were blended and dispersed using a Nippon Seiki NBK-2 to prepare a titanium dioxide dispersion solution (titanium dioxide pigment 40% by mass).

| (Titanium dioxide dispersion solution) | |
|---|---|
| Titanium dioxide (Tipec (registered trademark) A-220, Ishihara Sangyo) | 40.0 g |

-continued

| (Titanium dioxide dispersion solution) | |
|---|---|
| PVA102 | 2.0 g |
| Ion exchange water | 58.0 g |

(Toner Image-receiving Layer Coating Solution)

The following components were mixed and stirred to prepare a toner image-receiving layer coating solution.

| | |
|---|---|
| Aforesaid titanium dioxide dispersion solution | 15.5 g |
| Carnauba wax dispersion solution (Cellosol 524, Chukyo Oils and Fats) | 15.0 g |
| Polyester resin water dispersion (solids 30% by mass, KZA-7049, Unitika Ltd.) | 100.0 g |
| Thickener (Alcox E30, Meisei Chemicals) | 2.0 g |
| Anionic surfactants (AOT) | 0.5 g |
| Ion exchange water | 80 ml |

The viscosity of the toner image-receiving layer coating solution was 40 mpa·s, and its surface tension was 34 mN/m.

Preparation of Backing Layer Coating Solution

The following components were mixed and stirred to prepare a backing layer coating solution.

| (Backing layer coating solution) | |
|---|---|
| Acrylate resin water dispersion (solids 30% by mass, High-loss XBH-997L, Seiko Chemicals) | 100.0 g |
| Matting agent (Tecpoma-MBX-12, Sekisui Chemical Industries) | 5.0 g |
| Releasing agent (Hydrine D337, Chukyo Oils and Fats) | 10.0 g |
| Thickener (CMC) | 2.0 g |
| Anionic surfactant (AOT) | 0.5 g |
| Ion exchange water | 80 ml |

The viscosity of the backing layer coating solution was 35mPa·s, and its surface tension was 33 mN/m.

Coating of Backing Layer and Toner Image-receiving Layer

The aforesaid backing layer coating solution was applied to the back surface of the raw paper by a bar coater, and the toner image-receiving layer coating solution was applied to the other surface of the raw paper by a bar coater in the same way as the backing layer.

The toner image-receiving layer coating solution and backing layer coating solution were applied so that, for the backing layer, the coating amount is 9 g/m$^2$ in terms of dry mass, and for the toner image-receiving layer, the coating amount was 12 g in terms of dry mass.

After the backing layer and toner image-receiving layer were applied, they were dried by hot air online. The dry air amount and temperature were adjusted so that drying takes place within 2 minutes after coating for both the back surface and toner image-receiving surface. The drying temperature was set so that the coating surface temperature is identical to the wet bulb temperature of the dry air.

After drying, calender treatment was performed. The calender treatment was performed by a gloss calender with the metal rollers kept warm at 40° C., at a pressure of 147 N/cm (15 kgf/cm). In this way, the electrographic image-receiving sheet of Example 11 was manufactured.

Examples 12 to 16 and Comparative Examples 7 to 9

The electrographic image-receiving sheets of Examples 12 to 16 and Comparative Examples 7 to 9 were manufactured in an identical way to that of Example 11, except that the fiber length of the pulp used for the raw paper, the sizing agent used for surface treatment of the raw paper, calender treatment conditions and density of the raw paper were changed so that the Oken type smoothness and Stökigt sizing degree were different, as shown in Tables 3 and 4.

Image quality, glossiness, gloss, average surface roughness, L*a*b* value and reflectance for the electrophotographic image-receiving sheets of Examples 11 to 16 and Comparative Examples 7 to 9, were evaluated by the following methods. The results are shown in Table 4.

<Evaluation>

The electrophotographic image-receiving sheets were cut in A4 size, and an image was formed by the following method. The printer was a Fuji Xerox color laser printer (DocuColor 1250-PF) modified with the fixing belt system shown in FIGURE, which is identical to that of Examples 1 to 10.

Image Quality

The electrophotographic image-receiving sheets were evaluated by forming a portrait of woman by the above-mentioned process for image formation, according to the following criteria.

[Evaluation Criteria]

A: Best

B: Good, can be used (within tolerance).

C: Poor, cannot be used (cannot be used in practice).

D: Very poor, cannot be used.

Glossiness

Glossiness was visually observed on an electrophotography print after printing the electrophotographic image-receiving sheets. The best glossiness was A, followed by ranks B, C and D.

[Evaluation Criteria]

A: Best

B: Good, can be used (within tolerance).

C: Poor, cannot be used (cannot be used in practice).

D: Very poor, cannot be used.

Glossiness

This was measured based on the toner image-forming side of each electrophotographic image-receiving sheets according to JIS Z 8741.

Average Surface Roughness

The average surface roughness (Ra) of the toner image-forming side of each electrophotographic image-receiving sheets was measured based on JIS B 0601, B 0651 and B 0652.

L*a*b* Value

The L*a*b* value of the toner image-forming side of each electrophotographic image-receiving sheets was measured based on JIS Z 8730.

Reflectance

The reflectance (%) of the toner image-forming side of each electrophotographic image-receiving sheets to light in the wavelength range 450 nm to 700 nm, was measured.

TABLE 3

| | Raw paper pulp fiber length (mm) | Sizing agent (%, based on pulp mass) | Calender treatment type | Calender treatment temperature (° C.) | Raw paper density (g/cm$^3$) |
|---|---|---|---|---|---|
| Example 11 | 0.58 | AKD (0.5)<br>EFA (0.2) | Soft calendar | 140 | 1.01 |
| Example 12 | 0.63 | AKD (0.5)<br>EFA (0.2) | Soft calendar | 140 | 0.99 |
| Example 13 | 0.63 | AKD (0.5)<br>EFA (0.2) | Soft calendar | 140 | 0.93 |
| Example 14 | 0.55 | AKD (0.6) | Soft calendar | 170 | 1.03 |
| Example 15 | 0.58 | AKD (0.3) | Soft calendar | 140 | 0.95 |
| Example 16 | 0.58 | AKD (0.2) | Machine calendar | 150 | 0.97 |
| Comp. Ex. 7 | 0.69 | AKD (0.6) | Soft calendar | 140 | 0.93 |
| Comp. Ex. 8 | 0.73 | AKD (0.6) | Machine calendar | 40 | 0.78 |
| Comp. Ex. 9 | 0.75 | Neutral rosin (0.3) | Machine calender | 40 | 0.91 |

In Table 3, AKD denotes alkyl ketene dimer, EFA denotes epoxy fatty acid amide.

TABLE 4

| | Example | | | | | | Comp. Ex. | | |
|---|---|---|---|---|---|---|---|---|---|
| | 11 | 12 | 13 | 14 | 15 | 16 | 7 | 8 | 9 |
| Oken type smoothness (seconds) | 265 | 245 | 212 | 301 | 232 | 240 | 198 | 53 | 211 |
| Stökigt sizing degree (seconds) | 227 | 234 | 125 | 176 | 153 | 132 | 185 | 230 | 86 |
| Image quality | A | B | B | A | B | B | C | D | C |
| Glossiness | A | A | B | A | B | A | C | D | D |
| Gloss | 41 | 36 | 32 | 40 | 33 | 39 | 18 | 15 | 16 |
| Average surface roughness (μm) | 0.8 | 1.0 | 1.4 | 0.7 | 1.2 | 1.0 | 1.9 | 2.3 | 1.6 |
| L* | 95.4 | 95.2 | 94.7 | 94.8 | 93.8 | 95.0 | 91.3 | 90.3 | 91.8 |
| a* | −0.86 | −0.87 | −0.85 | −0.83 | −0.83 | −0.85 | −0.81 | −0.88 | −0.84 |
| b* | 1.67 | 1.69 | 1.70 | 1.69 | 1.75 | 1.68 | 1.82 | 1.91 | 1.86 |
| Reflectance (%) | 86–89 | 82–87 | 81–86 | 86–88 | 81–85 | 83–88 | 82–87 | 81–85 | 81–87 |

From the results of Table 4, it is seen that in Examples 11 to 16, due to the use of raw papers having an Oken type smoothness of 210 seconds or more and a Stökigt sizing degree of 100 seconds or more, superior image quality and gloss were obtained in comparison to Comparative Examples 7 to 9.

Further, in Examples 11 to 16, due to the use of raw papers wherein the Oken type smoothness is 210 seconds or more, the Stökigt sizing degree is 100 seconds or more, the gloss of the toner image-forming surface is 20 or more, the average surface roughness is 2 μm or less, and in an L*a*b* space, $80<L^*$, $-2<a^*<2$, $-10<b^*<2$, the reflectance to light in the wavelength range 450 nm to 700 nm is 80% or more, and the difference between the maximum reflectance and minimum reflectance to light in this wavelength range is 5% or less, even better image quality and gloss were obtained.

According to the present invention, a recording material support having outstanding surface smoothness and water resistance compared to that of the related art, is obtained. By using this recording material support as a support for a recording material, a recording material which can form images of excellent quality and gloss can therefore be provided.

What is claimed is:

1. A recording material support comprising:

raw paper, wherein the recording material support satisfies at least one of the following conditions (i) to (iii):

(i) Cobb size (30 seconds) of a surface of the recording material support where an image-forming layer is provided, is 10g/m$^2$ or less;

(ii) Oken type smoothness of a surface of the recording material support where an image-forming layer is provided, is 210 seconds or more, and Stdkigt sizing degree thereof is 100 seconds or more;

(iii) Central surface average roughness (SRa) measured at a cutoff of 5 mm to 6 mm on a surface of the recording material support where an image-forming layer is provided, is 0.7 μm or less, and variation [ΔSRa; (SRa before contacting water)−(SRa after contacting water)] of the SRa before and after the surface thereof is brought into contact with water at 20°C. for 2 minutes, is in the range of −0.1 μm to +0.1 μm, and wherein the pulp mass average fiber length of the raw paper is in the range of 0.40 mm to 0.70 mm.

2. A recording medium support according to claim 1, wherein Bekk smoothness of the surface of the recording material support where an image-forming layer is provided, is 100 seconds or more.

3. A recording material support according to claim 1, wherein the raw paper comprises a pulp having a freeness of 200 mlC.S.F. to 440 mlC.S.F.

4. A recording material support according to claim 1, wherein the raw paper comprises a pulp having an average mass fiber length of 0.50 mm to 0.65 mm.

5. A recording material support according to claim 1, wherein at least a surface of the raw paper where an image-forming layer is provided, is one of coated and impregnated with at least one of a water repellent, a sizing agent, a water-resisting agent and a surface-treating agent.

6. A recording material support according to claim 5, wherein the sizing agent is at least one of an alkyl ketene dimer and epoxy fatty acid amide, and a content of the sizing agent in the recording material support is 0.3% by mass or more, relative to pulp mass of the raw paper.

7. A recording material support according to claim 5, wherein the surface-treating agent is at least one of a soap-free latex and a soap-free emulsion.

8. A recording material comprising:

a recording material support which comprises raw paper; and an image-forming layer which is provided at least one surface of the recording material support, wherein the recording material satisfies at least one of the following conditions (i) to (iii):

(i) Cobb size (30 seconds) of a surface of the recording material support where an image-forming layer is provided, is 10g/m$^2$ or less;

(ii) Oken type smoothness of a surface of the recording material support where an image-forming layer is provided, is 210 seconds or more, and Stökigt sizing degree thereof is 100 seconds or more;

(iii) Central square average roughness (SRa) measured at a cutoff of 5 mm to 6 mm on a surface of the recording material support where an image-forming layer is provided, is 0.7 μm or less, and variation [ASRa; (SRa before contacting water)−(SRa after contacting water)] of the SRa before and after the surface thereof is brought into contact with water at 20° C. for 2 minutes, is in the range of −0.1 μm to +0.1 μm, and wherein the pulp mass average fiber length of the raw paper is in the range of 0.40 mm to 0.70 mm.

9. A recording material according to claim 8, wherein the recording material is at least one of an electrophotographic image-receiving material, a thermosensitive color recording material, an ink-jet recording material, a sublimation transfer image-receiving material, a silver photographic photosensitive material and a heat transfer image-receiving material.

10. A recording material according to claim 9, wherein the recording material is an electrophotographic image-receiving material having a toner image-receiving layer provided on at least one surface of the recording material, and the toner image-receiving layer contains 40% by mass or less of a pigment, relative to a mass of thermoplastic resin forming the toner image-receiving layer.

11. A recording material according to claim 10, wherein a gloss of a surface of the toner image-forming layer is 20 or more.

12. A recording material according to claim 10, wherein an average surface roughness of the toner image-forming layer is 2 μm or less.

13. A recording material according to claim 10, wherein the toner image-forming layer satisfies the condition of $80<L^*$, $-2<a^*<2$, $-10<b^*<2$, in a L*a*b* space.

14. A recording material according to claim 10, wherein a reflectance of the toner image-forming layer to light in the wavelength range of 450 nm to 700 nm, is 80% or more, and a difference between a maximum reflectance and a minimum reflectance to light in the wavelength range, is 5% or less.

15. A process for manufacturing a recording material support comprising the steps of:

applying a coating solution on a surface of raw paper of the recording material support where an image-forming layer is provided; and performing a calender treatment on the raw paper after the step of applying, wherein the coating solution comprises at least one surface-treating agent selected from the group consisting of a soap-free latex and a soap-free emulsion;

the raw paper of the recording material support has a pulp mass average fiber length in the range of 0.40 mm to 0.70 mm;

and the recording material support satisfies at least one of the following conditions (i) to (iii):

(i) Cobb size (30 seconds) of a surface of the recording material support where an image-forming layer is provided, is 10 g/m$^2$ or less;

(ii) Oken type smoothness of a surface of the recording material support where an image-forming layer is provided, is 210 seconds or more, and Stökigt sizing degree thereof is 100 seconds or more;

(iii) Central surface average roughness (SRa) measured at a cutoff of 5 mm to 6 mm on a surface of the recording material support where an image-forming layer is provided, is 0.7 μm or less, and variation [SRa; (SRa before contacting water)−(SRa after contacting water)]of the SRa before and after the surface thereof is brought into contact with water at 200° C. for 2 minutes, is in the range of −0.1 μm to +0.1 μm.

16. A process for manufacturing a recording material support according to claim 15, wherein a coating amount of the coating solution is 0.5 g/m$^2$ to 10 g/m$^2$ in terms of solids.

17. A process for manufacturing a recording material support according to claim 15, wherein the calender treatment is performed using a calender having a metal roller with a surface temperature of 110° C. or more.

18. A process for image formation comprising the steps of:

forming a toner image on an electrophotographic image-receiving material;

heating and pressurizing a surface of the electrophotographic image-receiving material where the toner image is formed on, using a fixing belt and a fixing roller;

cooling the electrophotographic image-receiving material in which the toner image is fixed thereon; and separating the electrophotographic image-receiving material from the fixing belt, wherein the electrophotographic image-receiving material comprises:

a support comprising raw paper having a pulp mass average fiber length in the range of 0.40 mm to 0.70 mm; and a toner image-receiving layer on at least one surface of the support, and the electrophotographic image-receiving material satisfies at least one of the following conditions (i) to (iii):

(i) Cobb size (30 seconds) of a surface of the recording material support where an image-forming layer is provided, is 10 g/m$^2$ or less;

(ii) Oken type smoothness of a surface of the recording material support where an image-forming layer is provided, is 210 seconds or more, and Stökigt sizing degree thereof is 100 seconds or more;

(iii) Central square average roughness (SRa) measured at a cutoff of 5 mm to 6 mm on a surface of the recording material support where an image-forming layer is provided, is 0.7 μm or less, and variation [SRa;(SRa before contacting water)−(SRa after contacting water)]of the SRa before and after the surface thereof is brought into contact with water at 20° C. for 2 minutes, is in the range of −0.1 μm to +0.1 μm.

19. A process for image formation according to claim 18, wherein the toner image-receiving layer contains 40% by mass or less of a pigment, relative to a mass of thermoplastic resin forming the toner image-receiving layer.

20. A process for image formation according to claim 18, wherein the fixing belt comprises a layer formed of fluorocarbon siloxane rubber having at least one of a perfluoroalkyl ether group and a perfluoroalkyl group in a principal chain thereof, on a surface of the fixing belt.

21. A process for image formation according to claim 18, wherein the fixing belt comprises a layer formed of silicone rubber on a surface of the fixing belt, and a layer formed of fluorocarbon siloxane rubber having at least one of a perfluoroalkyl ether group and a perfluoro alkyl group in a principal chain thereof on a surface of the silicone rubber.

* * * * *